US011619149B2

(12) United States Patent
Taylor et al.

(10) Patent No.: US 11,619,149 B2
(45) Date of Patent: Apr. 4, 2023

(54) COMPACT ENGINE BRAKE WITH PRESSURE-CONTROL RESET

(71) Applicant: Pacbrake Company, Blaine, WA (US)

(72) Inventors: Kody Taylor, Surrey (CA); James Baldwin, Coquitlam (CA); Peter Stec, Vancouver (CA)

(73) Assignee: Pacbrake Company, Blaine, WA (US)

( * ) Notice: Subject to any disclaimer, the term of this patent is extended or adjusted under 35 U.S.C. 154(b) by 0 days.

(21) Appl. No.: 17/703,361

(22) Filed: Mar. 24, 2022

(65) Prior Publication Data

US 2022/0307392 A1 Sep. 29, 2022

Related U.S. Application Data

(60) Provisional application No. 63/165,873, filed on Mar. 25, 2021.

(51) Int. Cl.
*F01L 13/06* (2006.01)
*F01L 9/10* (2021.01)
(Continued)

(52) U.S. Cl.
CPC ..... *F01L 13/065* (2013.01); *F01L 1/18* (2013.01); *F01L 1/181* (2013.01); *F01L 1/22* (2013.01);
(Continued)

(58) Field of Classification Search
CPC . F01L 1/181; F01L 1/2411; F01L 2001/2444; F01L 1/267; F01L 1/462;
(Continued)

(56) References Cited

U.S. PATENT DOCUMENTS 6,386,160 B1 5/2002 Meneely et al.
10,767,522 B2 9/2020 Batcheller et al.
(Continued)

FOREIGN PATENT DOCUMENTS

CN 102733884 A 10/2012
CN 102235202 B 6/2014
(Continued)

OTHER PUBLICATIONS

International Search Report & Written Opinion dated Jul. 7, 2022 from related application PCT/US2022/021741 (15 pages).

*Primary Examiner* — Jorge L Leon, Jr.
(74) *Attorney, Agent, or Firm* — Calderon, Safran & Cole P.C.

(57) ABSTRACT

A compression-release engine brake system operating an exhaust valve of an engine during a compression-release engine braking operation. The compression-release brake system comprises an exhaust rocker arm and a brake reset device disposed in a reset bore formed in the exhaust rocker arm. The brake reset device comprises a reset check valve, a slider-piston slidably disposed in the reset bore and an external slider bias spring biasing the piston foot away from the brake reset device. The external slider bias spring is disposed outside the reset bore and around the piston-slider. The brake reset device permits pressurized hydraulic fluid to flow from a supply conduit to a reset conduit to supply a brake actuation piston when the reset check valve is open. The actuation piston extends and engages the exhaust valve toward the end of a compression stroke of the internal combustion engine, and the brake reset device resets.

20 Claims, 15 Drawing Sheets

(51) Int. Cl.

| | |
|---|---|
| ***F01L 9/40*** | (2021.01) |
| ***F01L 1/18*** | (2006.01) |
| ***F01L 1/22*** | (2006.01) |
| ***F01L 1/26*** | (2006.01) |
| ***F01L 1/46*** | (2006.01) |
| ***F02D 13/04*** | (2006.01) |
| ***F01L 1/24*** | (2006.01) |

(52) U.S. Cl.
CPC ..... *F01L 1/2411* (2013.01); *F01L 1/26* (2013.01); *F01L 1/267* (2013.01); *F01L 1/462* (2013.01); *F01L 9/10* (2021.01); *F01L 9/40* (2021.01); *F01L 13/06* (2013.01); *F02D 13/04* (2013.01); *F01L 2001/2444* (2013.01); *F01L 2001/467* (2013.01)

(58) Field of Classification Search
CPC ... F01L 2001/467; F01L 13/06; F01L 13/065; F02D 13/04
USPC ..... 123/90.4, 90.46
See application file for complete search history.

(56) References Cited

U.S. PATENT DOCUMENTS

| | | | | |
|---|---|---|---|---|
| 11,242,778 | B2 | 2/2022 | Batcheller et al. | |
| 2016/0356187 | A1* | 12/2016 | Meneely ..... | F01L 13/06 |
| 2019/0293001 | A1 | 9/2019 | Baltrucki et al. | |
| 2019/0309664 | A1* | 10/2019 | Batcheller ..... | F01L 1/181 |

FOREIGN PATENT DOCUMENTS

| | | | | | |
|---|---|---|---|---|---|
| CN | 104975898 | B | | 9/2017 | |
| CN | 110173321 | A | * | 8/2019 | ..... F01L 13/06 |
| CN | 209413958 | U | | 9/2019 | |
| CN | 210003346 | U | | 1/2020 | |
| CN | 210178433 | U | | 3/2020 | |
| CN | 111691942 | A | | 9/2020 | |
| EP | 1389270 | B1 | | 5/2006 | |

* cited by examiner

COMPACT ENGINE BRAKE WITH PRESSURE-CONTROL RESET

CROSS-REFERENCE TO RELATED APPLICATION AND CLAIM TO PRIORITY

This Application claims the benefit of U.S. Provisional Patent Application Ser. No. 63/165,873 filed Mar. 25, 2021 by Taylor et al., which is hereby incorporated herein by reference in its entirety and to which priority is claimed.

BACKGROUND OF THE INVENTION

1. Field of the Invention

The present invention relates to compression-release engine brake systems for internal combustion engines in general and, more particularly, to a "low profile" or compact compression-release brake reset mechanism for a compression-release engine brake system including an adjacent actuation piston and a proximate accumulator.

2. Description of the Related Art

For internal combustion engines (IC engine), especially four-stroke diesel engines of large trucks, engine braking is an important feature for enhanced vehicle safety. Consequently, the four-stroke diesel engines in vehicles, particularly large trucks, are commonly equipped with compression-release engine brake systems (or compression-release retarders) for retarding the engine (and thus, the vehicle as well). Compression release engine braking provides significant braking power when in braking mode of operation and the fuel supply deactivated. For this reason, compression-release engine brake systems have been in North America since the 1960's and gained widespread acceptance.

The typical compression-release engine brake system opens an exhaust valve(s) just prior to Top Dead Center (TDC) at the end of a compression stroke. This creates a blow-down of the compressed cylinder gas and the energy used for compression is not reclaimed. The result is engine braking, or retarding power. A conventional compression-release engine brake system has substantial cost associated with the hardware required to open the exhaust valve(s) against the extremely high load of the compressed cylinder charge. Valve train components must be designed and manufactured to operate reliably at both high mechanical loading and engine speeds. Also, the sudden release of the highly compressed gas comes with a high level of noise. In some areas, typically urban, engine brake use is not permitted because the existing compression-release engine brake systems open the valves quickly at high compression pressure near the TDC compression that produces high engine valve train loads and a loud sound. It is the loud sound that has resulted in prohibition of engine compression release brake usage in certain urban areas.

Exhaust brake systems can also be used on engines where compression release loading is too great for the valve train. In such instances, the exhaust brake mechanism typically consists of a restrictor element mounted in the exhaust system. When this restrictor is closed, backpressure resists the exit of gases during the exhaust cycle and provides a braking function. This system provides less braking power than a compression release engine brake, but also at less cost. As with a compression release brake, the retarding power of an exhaust brake falls off sharply as engine speed decreases. This happens because the restriction is optimized to generate maximum allowable backpressure at rated engine speed. The restriction is simply insufficient to be effective at the lower engine speeds.

Thus, while known compression-release engine brake systems have proven to be acceptable for various vehicular driveline applications, such devices are nevertheless susceptible to improvements that may enhance their performance, reduced overall size, robustness, and cost. To gain broader applicability of engine brake technology, overall size dimensions are a major consideration for the engine brake designer and engine manufacturer, ensuring safe clearances between the engine brake device and the surrounding valve train components. Overall engine brake height is a particularly important consideration. Increasing the height of the engine's valve cover is historically common for engine brake equipped engines. However, optimization and packaging restrictions are now common in the industry. Increases to valve cover height to allow for added engine brake clearance have down-stream effects to vehicle manufacturers. The vehicle manufacturer must allow for this increased clearance in truck design. Restrictions are therefore imposed on engine brake designers to adapt to existing architecture with minimal to zero changes allowable to the overall engine geometry.

SUMMARY OF INVENTION

According to a first aspect of the present invention, there is provided a compression-release engine brake system for effectuating a compression-release engine braking operation in connection with an internal combustion engine comprising at least one exhaust valve and at least one exhaust valve spring exerting a closing force on the at least one exhaust valve to urge the at least one exhaust valve into a closed position. The engine is a four-stroke piston cycle comprising an intake stroke, a compression stroke, an expansion stroke and an exhaust stroke. The compression-release system comprises a lost motion exhaust rocker assembly that comprises an exhaust rocker arm, an actuation device including an actuation piston slidably disposed in an actuation bore formed in the exhaust rocker arm and movable between retracted and extended positions, and a reset device including a reset check valve disposed in a reset bore in the exhaust rocker arm, a slider-piston slidably disposed in the reset bore of the exhaust rocker arm and operatively connected to the reset check valve, a reset pressure control spring disposed within the slider-piston, and an external slider bias spring biasing the slider-piston away from the reset bore to engage the at least one exhaust valve. The actuation device is operatively associated with the at least one exhaust valve to unseat the at least one exhaust valve from the closed position. The external slider bias spring is disposed outside the reset bore in the exhaust rocker arm and around the piston-slider. The actuation bore defines an actuation cavity delimited by the actuation piston within the actuation bore above the actuation piston. The reset bore is in fluid communication with the actuation cavity in the actuation device through a reset conduit within the exhaust rocker arm. The reset check valve is operable between an open position and a closed position. Hydraulic fluid is locked in the actuation cavity when the reset check valve is in the closed position, and flows bi-directionally through the reset check valve when the reset check valve is in the open position. The reset check valve is biased toward the open position by the reset pressure control spring. The slider-piston is moveable relative to the exhaust rocker arm between an extended position and a retracted position. The slider-piston is biased toward the extended position by the external slider bias spring. The slider assembly is operatively associated with the reset check valve so that in the extended position of the slider-piston the reset check valve is moveable toward the closed position, and in the retracted position of the slider-piston the reset check valve is moveable to the open position thereof by the slider-piston. The slider-piston is operatively associated with a stop member such that when the exhaust rocker arm is farthest away from the stop member, the slider-piston is in the extended position, and as the exhaust rocker arm rotates toward the stop member the slider-piston is moved toward the retracted position.

According to a second aspect of the present invention, there is provided a method of operation of a compression-release engine brake system in a brake-on mode for operating at least one exhaust valve of an internal combustion engine during a compression-release engine braking operation. The compression-release brake system maintains the at least one exhaust valve open during a portion of a compression stroke of the engine when performing the compression-release engine braking operation. The compression-release brake system comprises a lost motion exhaust rocker assembly that comprises an exhaust rocker arm, an actuation device including an actuation piston slidably disposed in an actuation bore formed in the exhaust rocker arm and movable between retracted and extended positions, and a reset device. The actuation device is operatively associated with the at least one exhaust valve to unseat the at least one exhaust valve from the closed position. The reset device includes a reset check valve disposed in a reset bore in the exhaust rocker arm, a slider-piston slidably disposed in the reset bore of the exhaust rocker arm and operatively connected to the reset check valve, a reset pressure control spring disposed within the slider-piston, and an external slider bias spring biasing the slider-piston away from the reset bore to engage the at least one exhaust valve. The external slider bias spring is disposed outside the reset bore in the exhaust rocker arm and around the piston-slider. The actuation bore defines an actuation cavity delimited by the actuation piston within the actuation bore above the actuation piston. The reset bore is in fluid communication with the actuation cavity in the actuation device through a reset conduit within the exhaust rocker arm. The reset check valve is operable between an open position and a closed position. Hydraulic fluid is locked in the actuation cavity when the reset check valve is in the closed position and flows bi-directionally through the reset check valve when the reset check valve is in the open position. The reset check valve is biased toward the open position by the reset pressure control spring. The slider-piston is movable relative to the exhaust rocker arm between an extended position and a retracted position, the slider-piston being biased toward the extended position by the external slider bias spring. The slider assembly is operatively associated with the reset check valve so that in the extended position of the slider-piston the reset check valve is moveable toward the closed position, and in the retracted position of the slider-piston the reset check valve is moveable to the open position thereof by the slider-piston. The method comprises the steps of mechanically and hydraulically biasing the reset check valve closed during a lost-motion rotation of the exhaust rocker arm, executing a brake valve lift of the at least one exhaust valve of the internal combustion engine, and resetting the at least one exhaust valve of the engine by opening the reset check valve and releasing hydraulic fluid from the actuation cavity to close the at least one exhaust valve.

The present invention is an engine brake design that reduces the overall size and height of the current engine brake technology shown, for example, in U.S. Pat. No. 10,767,522, which is incorporated herein by reference. The disclosed invention re-configures the components of a modern resetting engine brake in order to reduce the overall height of the brake system. Further improvements are made to the existing technology to improve robustness of critical interfaces and allow greater control over these connections.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In these drawings.

DETAILED DESCRIPTION OF PREFERRED EMBODIMENTS

Figure 1:
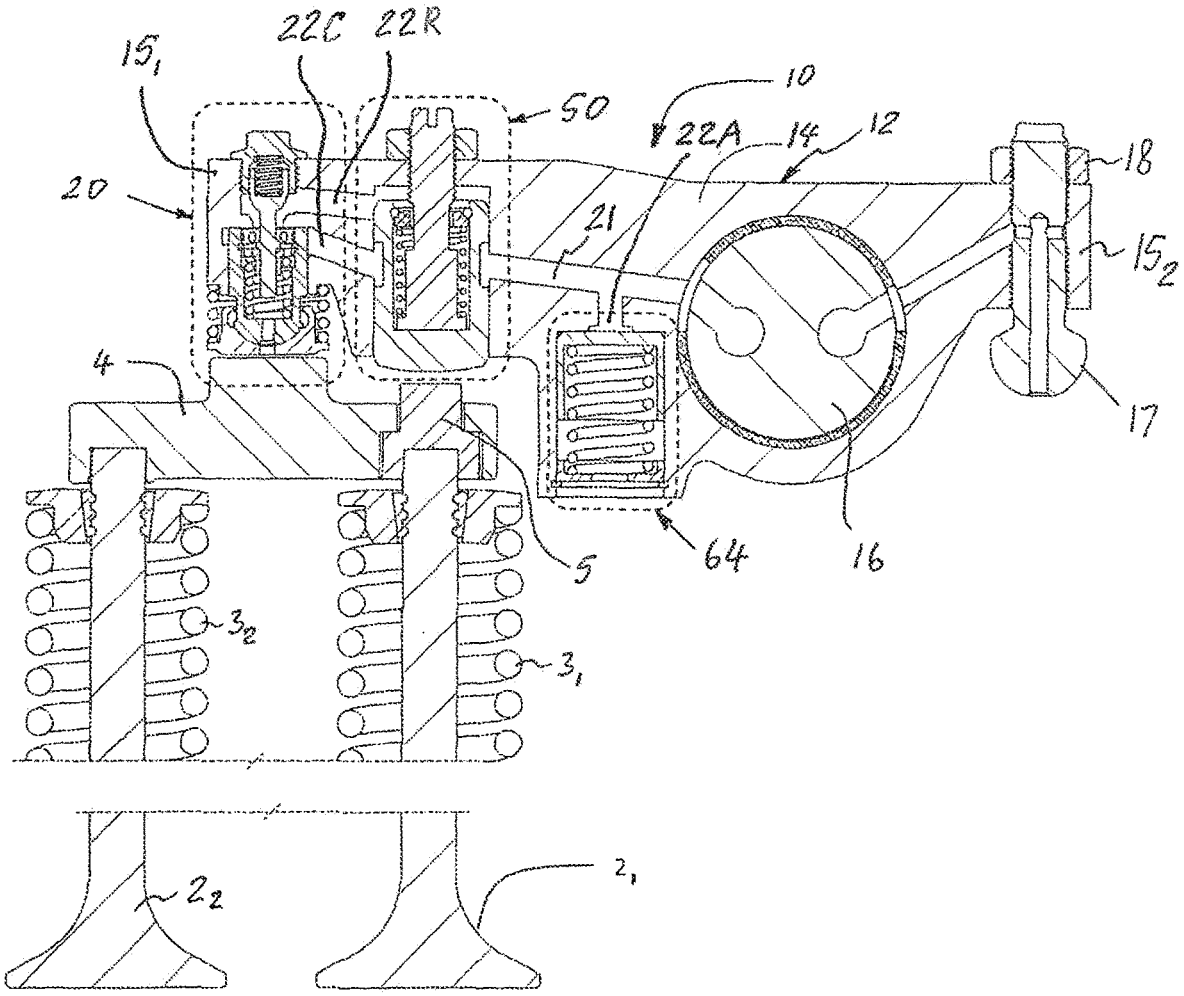
FIG. 1 shows a sectional view of a low-profile compression-release engine brake system according to a first exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiment(s) is intended to be read in connection with the accompanying drawings, which are to be considered part of the entire written description. In the description, relative terms such as "horizontal," "vertical," "up," "down," "upper", "lower", "right", "left", "top" and "bottom", "front" and "rear", "inwardly" and "outwardly" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "integrally") or "unitary" (or "unitarily") relates to a part made as a single part, or a part made of separate components fixedly (i.e., non-moveably) connected together. The words "smaller" and "larger" refer to relative size of elements of the apparatus of the present invention and designated portions thereof. Additionally, the word "a" and "an" as used in the claims means "at least one" and the word "two" as used in the claims means "at least two". For the purpose of clarity, some technical material that is known in the related art has not been described in detail in order to avoid unnecessarily obscuring the disclosure.

The present invention is an engine brake design that reduces the overall size and height of the current engine brake technology shown, for example as shown in U.S. Pat. No. 10,767,522, which is incorporated herein by reference in its entirety. FIG. 1 shows a cross-section of a low-profile compression-release engine brake system 10 with a common four-stroke diesel engine architecture according to a first exemplary embodiment of the present invention. The compression-release engine brake system 10 is configured for an internal combustion engine having one or more exhaust valve(s), although two exhaust valves: a first exhaust valve $\mathbf{2}_1$ and a second exhaust valve $\mathbf{2}_2$, are shown in FIG. 1. An exhaust valve bridge 4 is provided to transfer motion from an exhaust rocker arm to the underlying first and second exhaust valves $\mathbf{2}_1$ and $\mathbf{2}_2$. The exhaust valve bridge 4 is provided with a single-valve actuation thru-pin 5 to allow a single exhaust valve (the first exhaust valve $\mathbf{2}_1$) to be operated in engine braking mode.

The compression-release engine brake system 10 includes a lost motion exhaust rocker assembly 12 for operating at least one of the first exhaust valve $\mathbf{2}_1$ and the second exhaust valve $\mathbf{2}_2$. The lost motion exhaust rocker assembly 12, shown in FIG. 1, is a lost motion type provided with automatic hydraulic adjusting and resetting functions. The lost motion exhaust rocker assembly 12 includes an exhaust rocker arm 14 pivotally mounted about a rocker shaft 16 and provided to open the first and second exhaust valves $\mathbf{2}_1$ and $\mathbf{2}_2$ through the exhaust valve bridge 4. The rocker shaft 16 extends through a rocker arm bore formed in the exhaust rocker arm 14 (as best shown in FIG. 1). The rocker shaft 16 allows the exhaust rocker arm 14 to transfer camshaft motion to the exhaust valves $\mathbf{2}_1$ and $\mathbf{2}_2$ through the exhaust valve bridge 4, i.e., moving one or both of the exhaust valves $\mathbf{2}_1$ and $\mathbf{2}_2$ into an open position, which are returned to the closed position by the exhaust valve springs $\mathbf{3}_1$ and $\mathbf{3}_2$. The exhaust valve bridge 4 defines a stop member of the rocker arm compression-release engine brake system 10.

Figure 2:
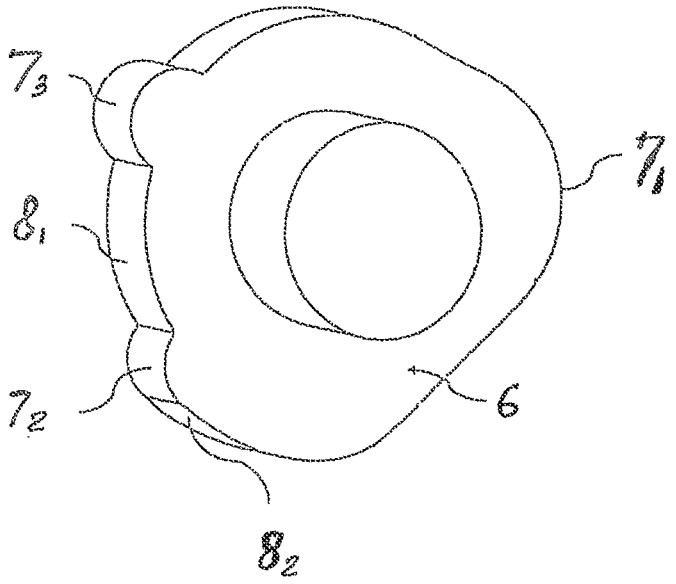
FIG. 2 is a fragmentary perspective view of an exhaust cam and shaft according to an exemplary embodiment of the present invention.

The rocker arm compression-release engine brake system 12 is operated by an exhaust valve cam 6, as best shown in FIG. 2. The exhaust valve cam 6 has a normal (conventional) engine exhaust cam profile $\mathbf{7}_1$, an engine brake lift profile $\mathbf{7}_2$ for a compression-release engine braking event during the engine brake operation, and a pre-charge lift profile $\mathbf{7}_3$ (as best shown in FIG. 2). The cam lift profiles $\mathbf{7}_1$, $\mathbf{7}_2$ and $\mathbf{7}_3$ are stylized for purposes of explanation. A phase of the exhaust valve cam 6 after the normal exhaust cam profile $\mathbf{7}_1$ and between the pre-charge lift profile $\mathbf{7}_3$ and the engine brake lift profile $\mathbf{7}_2$ that is constant radius is termed as a lower base circle $\mathbf{8}_1$. The phase of the exhaust valve cam 6 between the engine brake lift profile $\mathbf{7}_2$ and the normal exhaust cam profile $\mathbf{7}_1$ that is constant radius is termed an upper base circle $\mathbf{8}_2$. The normal engine positive power operation (i.e., the normal engine cycle) incorporates sufficient clearance in the exhaust valve train to eliminate the engine brake lift profile $\mathbf{7}_2$ and the pre-charge lift profile $\mathbf{7}_3$ of the exhaust valve cam 6 during normal positive power engine operation. Specifically, positive power operation incorporates a greater clearance (lash) in the exhaust valve train than the difference in radii between the upper base circle $\mathbf{8}_2$ and the lower base circle $\mathbf{8}_1$, such that the engine brake lift profile $\mathbf{7}_2$ and the pre-charge lift profile $\mathbf{7}_3$ are not imparted to the exhaust valve(s) $\mathbf{2}_1$ or $\mathbf{2}_2$ during the normal positive power engine operation.

The compression-release brake system 10 operates in the compression brake-on mode during engine brake operation and in a compression brake deactivation (or brake-off) mode during positive power operation.

The exhaust rocker arm 14, as best shown in FIG. 1, has two ends: a driving (first distal) end $\mathbf{15}_1$ controlling the engine exhaust valves $\mathbf{2}_1$ and $\mathbf{2}_2$, and a driven (second distal) end $\mathbf{15}_2$. The exhaust rocker arm 14 is configured to be used with a push-tube (pushrod) engine, and has a push-rod type interface including an adjusting screw 17 and a lock-nut 18 combination at the driven end $\mathbf{15}_2$ of the exhaust rocker arm 14 to set the exhaust valve lash.

The lost motion exhaust rocker assembly 12 further comprises a low-profile brake reset device 20, an actuation piston assembly 50, and an accumulator device 64, all mounted to the exhaust rocker arm 14. The low-profile brake reset device 20 is disposed above the exhaust valve bridge 4 in the driving end $\mathbf{15}_1$ of the exhaust rocker arm 14. The brake reset device 20 is configured to drive the exhaust valve bridge 4 during positive power operation, i.e., normal exhaust valve operation, and is used to open the exhaust valve $\mathbf{2}_1$ during an end portion of the compression stroke of the internal combustion engine when the engine brake system 10 is in the ON (braking mode) state. Moreover, the exhaust rocker arm 14 has a supply conduit 21, a connecting conduit 22C and a reset conduit 22R, all formed within the exhaust rocker arm 14, best shown in FIG. 1. The supply conduit 21 fluidly connects a source of pressurized hydraulic fluid (e.g., motor oil), disposed outside the exhaust rocker arm 14, to the actuation piston assembly 50. The connecting conduit 22C and the reset conduit 22R are two separate channels, spaced from each other and fluidly interconnecting the brake reset device 20 and the actuation piston assembly 50.

Figure 3A:
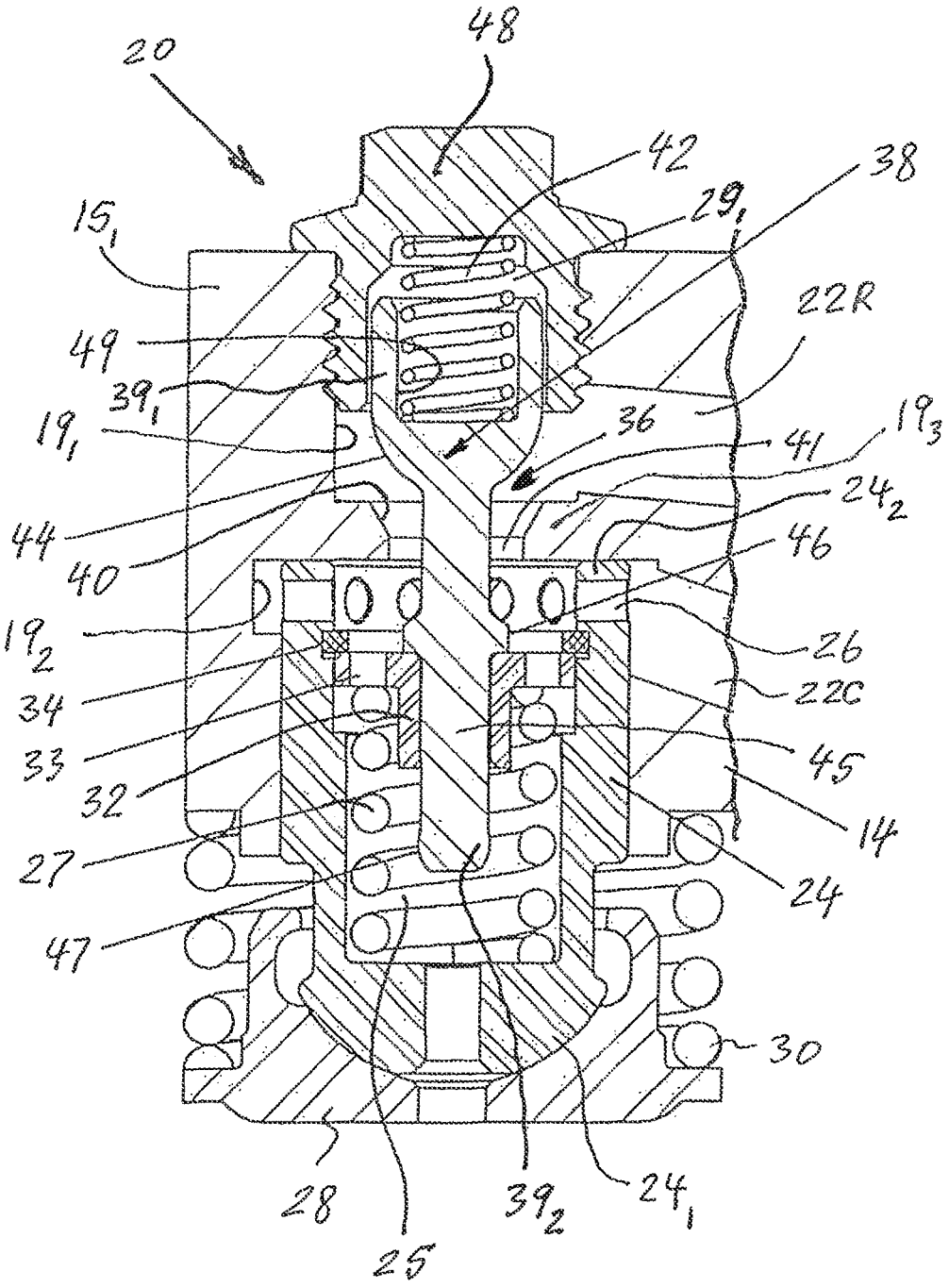
FIG. 3A shows a low-profile brake reset device according to the first exemplary embodiment of the present invention with the slider-piston in a retracted position.
Figure 3B:
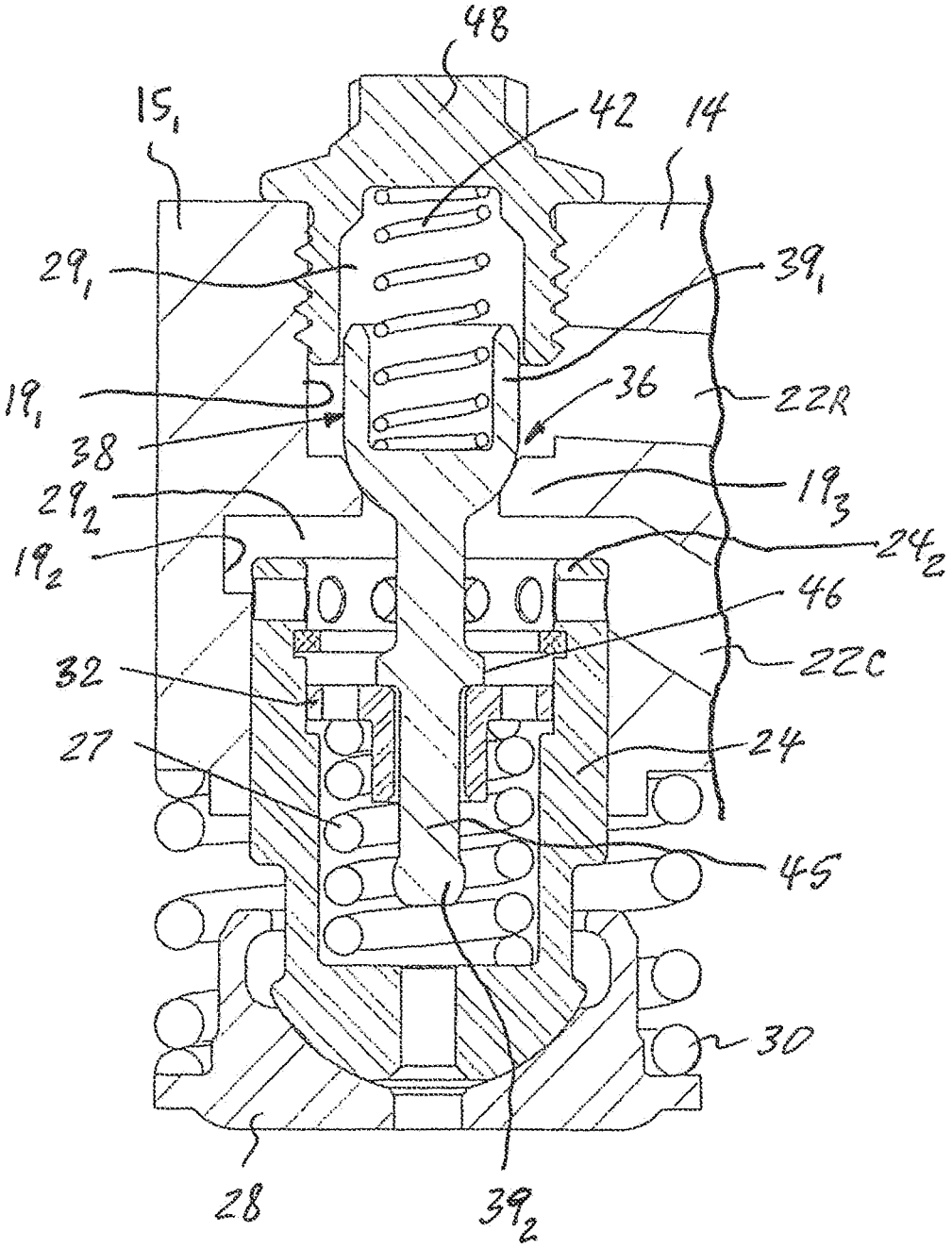
FIG. 3B shows the brake reset device according to the first exemplary embodiment of the present invention with a reset check valve closed.
Figure 3C:
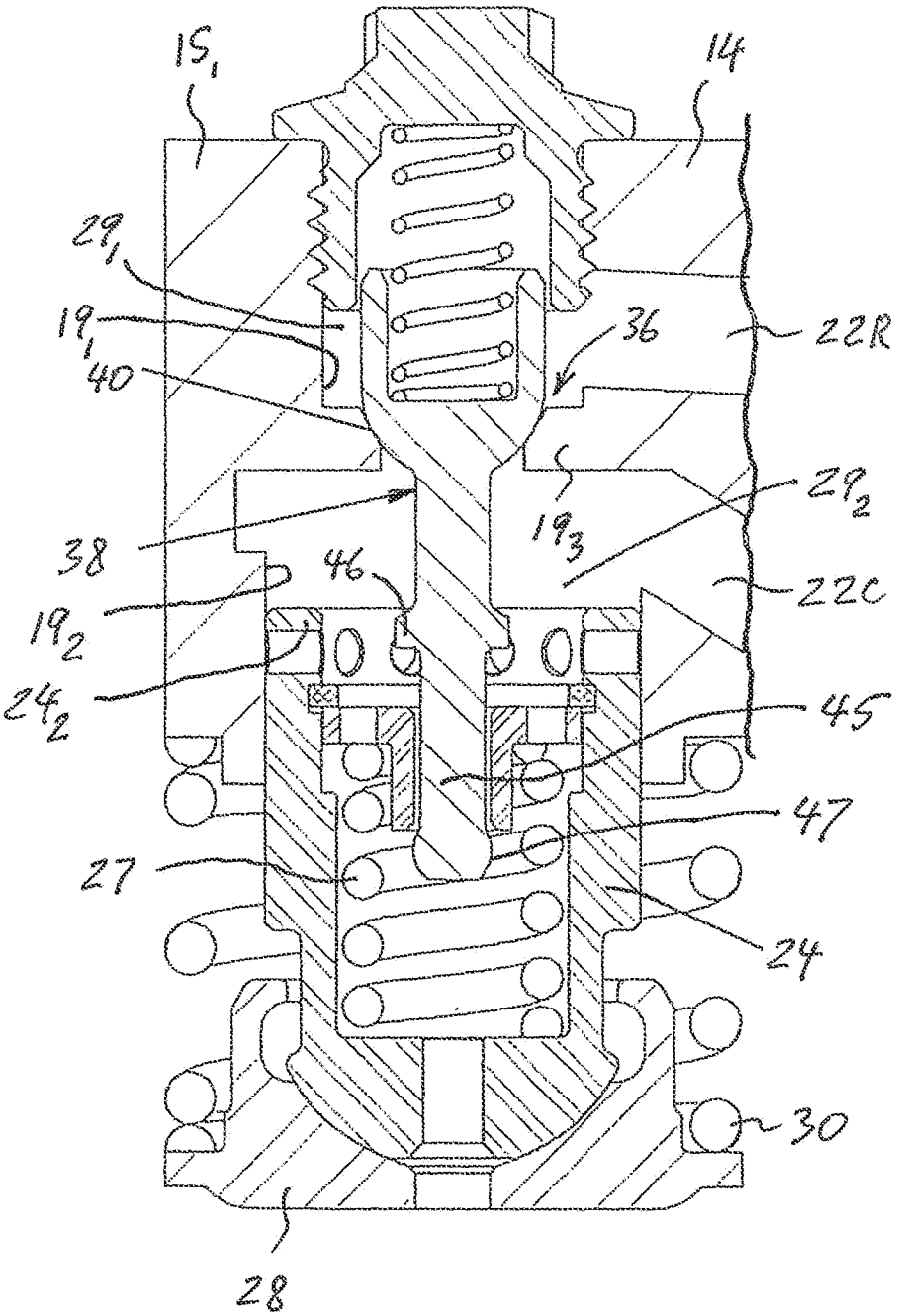
FIG. 3C shows the brake reset device according to the first exemplary embodiment of the present invention with the slider-piston in an extended position.

The low-profile brake reset device 20, as best shown in FIGS. 3A-3C, is disposed in a cylindrical upper reset bore $\mathbf{19}_1$ formed in the exhaust rocker arm 14 and defining a valve cavity $\mathbf{29}_1$. The upper reset bore $\mathbf{19}_1$ is closed from the top by a reset cap 48, which is secured to the exhaust rocker arm 14 for example by threaded connection. The low-profile brake reset device 20 includes a hollow slider-piston 24 configured to rectilinearly reciprocate within a cylindrical lower reset bore $\mathbf{19}_2$ formed in the exhaust rocker arm 14 beneath the upper reset bore $\mathbf{19}_1$ and separated therefrom by a separation wall $\mathbf{19}_3$. A reset pressure control spring 27 is disposed within the slider-piston 24. A piston (so called "elephant") foot 28 is mounted so as to swivel on a distal end of the slider-piston 24 adjacent to the exhaust valve bridge 4. An external slider bias spring 30 is disposed outside the reset bore $\mathbf{19}_1$, $\mathbf{19}_2$ of the exhaust rocker arm 14 and around the piston-slider 24 and acts between the piston foot 28 and the exhaust rocker arm 14 and applies a separating force between the exhaust rocker arm 14 and the piston foot 28 for biasing the slider-piston 24 in a direction away from the exhaust rocker arm 14 and toward the exhaust valve bridge 4. Thus, the external slider bias spring 30 maintains pressure between the piston foot 28 and the exhaust valve bridge 4. The slider-piston 24 is movable relative to the exhaust rocker arm 14 between a retracted position (shown in FIG. 3A) and an extended position (shown in FIG. 3C). The lower reset bore $\mathbf{19}_2$ defines a slider-piston cavity $\mathbf{29}_2$.

The external arrangement of the external slider bias spring 30 allows for a more compact design of the low-profile brake reset device 20 than previous technology, and allows for a much greater (larger) spring force to be used. The increased spring force helps to control high-speed dynamic motion of the valvetrain system, where vibrations can even cause the valve bridge to potentially fall off the exhaust valves 2. The upper reset bore $\mathbf{19}_1$ and the lower reset bore $\mathbf{19}_2$ of the exhaust rocker arm 14 are fluidly connected by a central opening 41 formed in the separation wall $\mathbf{19}_3$ therebetween. Also, the upper reset bore $\mathbf{19}_1$ and the lower reset bore $\mathbf{19}_2$ together define a reset bore for the exhaust rocker arm 14.

The slider-piston 24 defines a piston cavity 25 therewithin. The low-profile brake reset device 20 further comprises a spring washer 32 and a retaining ring 34, both disposed within the piston cavity 25. The spring washer 32 has one or more (i.e., at least one) openings 33 therethrough. The retaining ring 34 allows a set preload to be maintained on the reset pressure control spring 27, and also retains the reset pressure control spring 27 within the slider-piston 24.

The low-profile brake reset device 20, as best shown in FIGS. 3A-3C, further includes a reset check valve 36 disposed within the reset bore 19 of the exhaust rocker arm 14, mainly within the upper reset bore $\mathbf{19}_1$. The reset check valve 36 has a valve closing member 38, a check-valve seat 40 defined by the separation wall $\mathbf{19}_3$, and a check valve spring 42 disposed in the upper reset bore $\mathbf{19}_1$. The valve closing member 38 is urged toward the check-valve seat 40 by the biasing spring force of the check valve spring 42. The valve closing member 38, the check-valve seat 40, and the check valve spring 42 cause the reset check valve 36 to normally be biased closed (i.e., into a closed position) by the check valve spring 42. The check valve spring 42 is disposed between the valve closing member 38 and the reset cap 48. The slider-piston 24 of the reset device 20 is configured to drive the exhaust valve bridge 4 during normal exhaust valve motion.

The valve closing member 38 is integrally formed with a curved sealing portion 44 disposed in the upper reset bore $\mathbf{19}_1$ and complementary to the check-valve seat 40. An upset pin 45 is formed integrally with the valve closing member 38 and extends from the sealing portion 44 into the lower reset bore $\mathbf{19}_2$ through the central opening 41 in the and is partially disposed in the slider-piston 24. The upset pin 45 is integrally formed with a reset pin flange 46 to allow engagement with the spring washer 32. The sealing portion 44 of the valve closing member 38 has a cylindrical spring pocket 49 receiving the check valve spring 42 therein. As best shown in FIGS. 3A-3C, the spring pocket 49 is formed at an upper (or first) end $\mathbf{39}_1$ of the valve closing member 38 above the sealing portion 44. The spring pocket 49 protects the check valve spring 42 from contacting surrounding surfaces, improving the overall reliability of the brake reset device 20.

The valve closing member 38 is movable between a disengaged (or retracted) state, where the sealing portion 44 is spaced from the check-valve seat 40, as shown in FIG. 3A, and an engaged state, where the sealing portion 44 of the valve closing member 38 engages the check-valve seat 40. When the valve closing member 38 is in the retracted state—the reset check valve 36 is open (as shown in FIG. 3A), and when the valve closing member 38 is in the engaged state—the reset check valve 36 is closed (as shown in FIGS. 3B and 3C). In this way, the closing member 38 selectively opens or closes the central opening 41 so as to selectively fluidly connect or disconnect the connecting conduit 22C with or from the reset conduit 22R.

The spring washer 32 is slidably mounted about the upset pin 45 for supporting the reset pressure control spring 27 inside the slider-piston 24. Moreover, the spring washer 32 is rectilinearly moveable relative to the upset pin 45. The upset pin 45 has a retention section 47 at a lower (or second) end $\mathbf{39}_2$ of the valve closing member 38 (or of the upset pin 45 opposite the sealing portion 44). The retention section 47 of the upset pin 45 retains the spring washer 32 (thus, the slider-piston 24) on the upset pin 45 and prevents the spring washer 32 from becoming separated from the upset pin 45. This retention function is important for handling and installation of the brake reset device 20 into an engine, inasmuch as it maintains the engine brake as a single assembly within the driving end $\mathbf{15}_1$ of the exhaust rocker arm 14.

Figure 4:
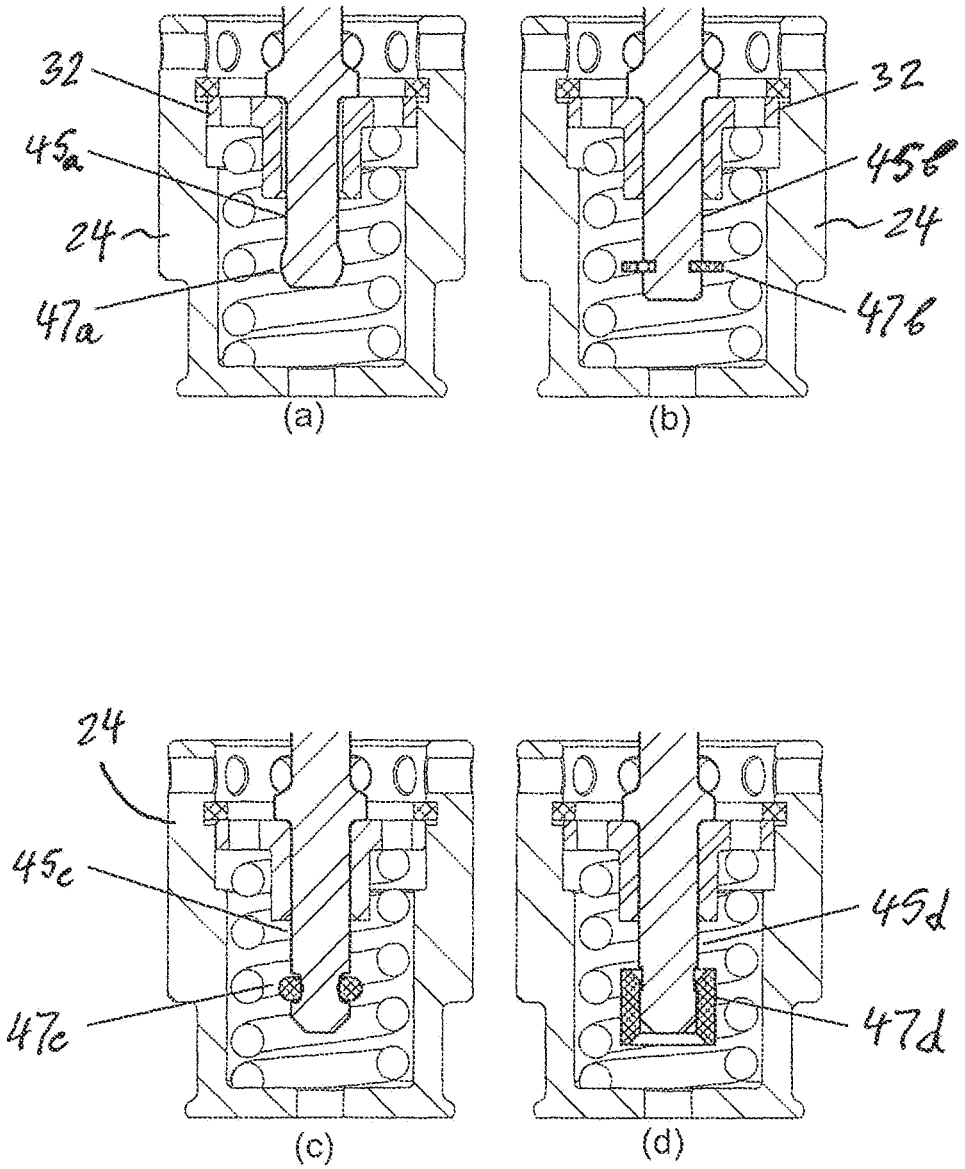
FIGS. 4 (*a*), (*b*), (*c*) and (*d*) show retention methods within the slider piston assembly of the compression-release engine brake system according to the first exemplary embodiment of the present invention.

FIG. 4 shows various alternative retention embodiments of the retention section 47. In FIG. 4(*a*), the upset pin 45*a* is integrally formed with an enlarged portion 47*a* at the second distal end $\mathbf{19}_2$ of the valve closing member 38, which is forced through the hole in the spring washer 32. The enlarged portion 47*a* acts as a travel limiter once the hole elastically returns, post assembly, to a smaller diameter than the enlarged portion 47*a*. In FIG. 4(*b*), the upset pin 45*b* uses an additional retaining clip 47*b* to act as a travel limiter for the spring washer 32. In FIG. 4(*c*), the upset pin 45*c* uses a round retainer 47*c* in the form of an O-ring to similarly limit the travel of the spring washer 32. In FIG. 4(*d*), the upset pin 45*d* uses an interference sleeve 47*d* to similarly limit the travel of the spring washer 32. These designs, using upset pins 45*a* or 45*d*, allow for blind installation of the pin and self-activation of the retention device. This simplifies the assembly process for the brake reset device 20. Designs using upset pins 45*b* or 45*c* allow for the installation steps to be closely monitored as the retention is exposed during assembly and can be inspected. The options above are not an exhaustive listing of possible retention methods for the upset pin.

The slider-piston 24 has a distal end $\mathbf{24}_1$ adjacent to the exhaust valve bridge 4, and a proximal end $\mathbf{24}_2$ facing the check-valve seat 40. The slider-piston 24 has one or more (i.e., at least one) piston ports 26 therethrough. The piston ports 26 are disposed below the check-valve seat 40 and the sealing portion 44 of the valve closing member 38 of the reset check valve 36 and maintain fluid connection between the piston cavity 25 of the slider-piston 24 with the lower reset bore $\mathbf{19}_2$ and the connecting conduit 22C, and with the upper reset bore $\mathbf{19}_1$ and the reset conduit 22R (when the reset check valve 36 is open) for all positions of the slider-piston 24.

The check-valve seat 40 has the central opening 41 therethrough, as best shown in FIG. 3A. The check-valve seat 40 is formed between the upper reset bore $\mathbf{19}_1$ and the lower reset bore $\mathbf{19}_2$ in the exhaust rocker arm 14. When the reset check valve 36 of the brake reset device 20 is open, as best shown in FIG. 3A, the upset pin 45 is held in an upper position by the reset pressure control spring 27 and the spring washer 32. The reset pressure control spring 27 forces the valve closing member 38 to rise, opening the reset check valve 36, as cylinder pressure within the IC engine falls, and allows bi-directional flow between the supply conduit 21 and the reset conduit 22R through the connecting conduit 22C, for thereby deactivating the associated brake actuation piston assembly 50 and directing pressurized fluid to the accumulator device 64 for pressurized storage.

FIG. 3C shows the slider-piston 24 of the brake reset device 20 in an extended position. In this position, the valve closing member 38 of the reset check valve 36 contacts the check-valve seat 40, and the slider-piston 24 is extended. In reaching this position, the reset check valve 36 only allows pressurized fluid flow from the connecting conduit 22C to the reset conduit 22R until the fully extended position of the slider-piston 24 is reached.

Figure 5:
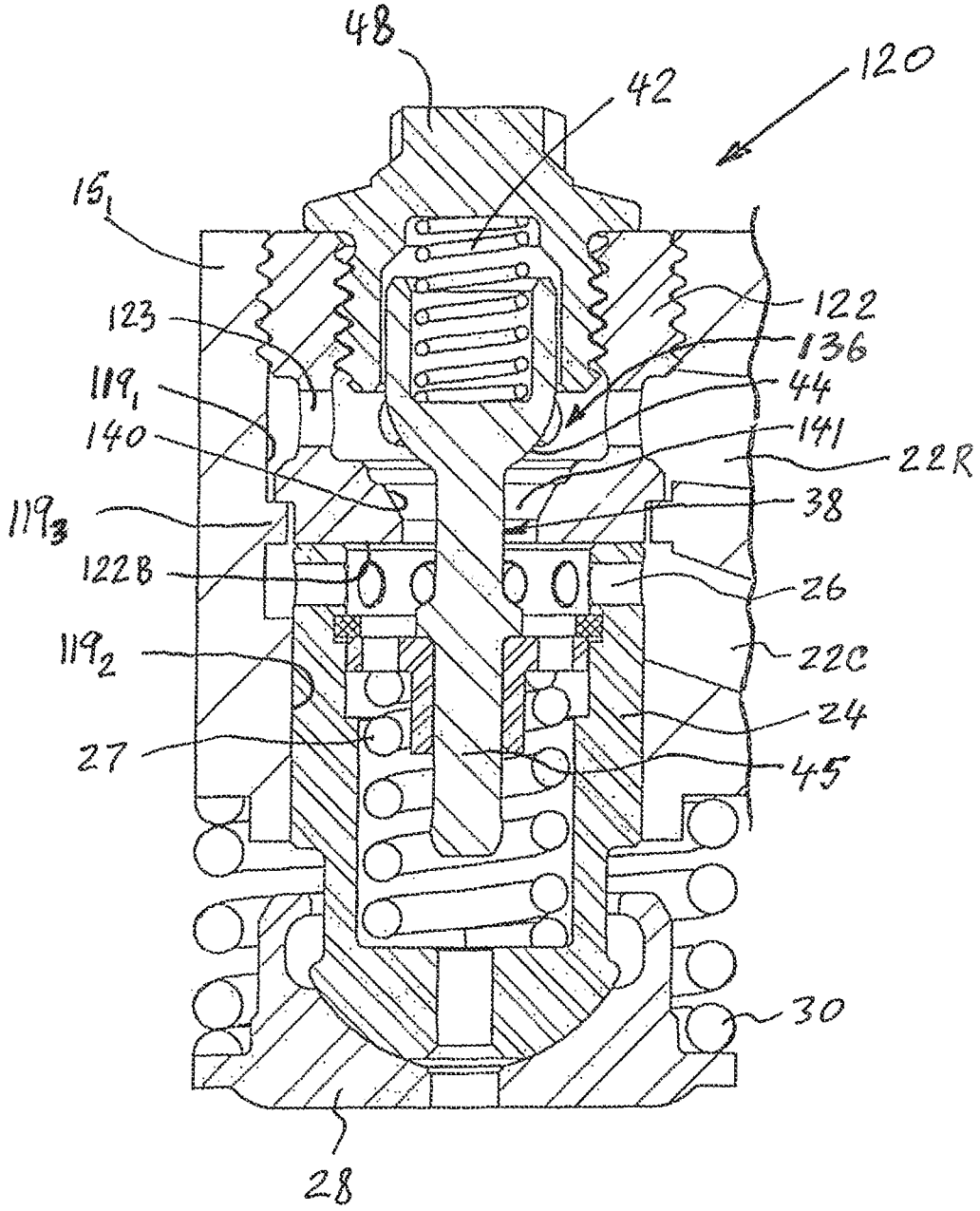
FIG. 5 shows an alternative embodiment of the low-profile brake reset device of the compression-release engine brake system according to the first exemplary embodiment of the present invention.

FIG. 5 illustrates an alternative exemplary embodiment of a low-profile brake reset device, generally depicted by the reference numeral 120. Components, which are unchanged from the first exemplary embodiment, are labeled with the same reference characters. Components, which function in the same way as in the first exemplary embodiment depicted in FIGS. 1 and 3A-3C are designated by the same reference numerals to some of which 100 has been added, sometimes without being described in detail since similarities between the corresponding parts in the two embodiments will be readily perceived by the reader.

The low-profile brake reset device 120 comprises a support body 122 having a cylindrical outer peripheral surface at least partially threaded into the upper reset bore $\mathbf{19}_1$ so as to be threadedly received in the partially internally threaded upper reset bore $\mathbf{19}_1$ in the driving end $\mathbf{15}_1$ of the exhaust rocker arm 14. The hollow slider-piston 24 is configured to rectilinearly reciprocate within the lower reset bore $\mathbf{19}_2$ formed in the exhaust rocker arm 14, and a reset check valve 136, as shown in FIG. 5.

The support body 122 defines a check-valve seat 140 for sealing against the sealing portion 44 of the valve closing member 38. A central opening 141 is formed in the check-valve seat 140, and a bearing surface 122B for supporting loads transmitted by the slider-piston 24. The central opening 141 fluidly connects the upper reset bore $\mathbf{119}_1$ and the lower reset bore $\mathbf{119}_2$ of the exhaust rocker arm 14. The upper reset bore $\mathbf{119}_1$ and the lower reset bore $\mathbf{119}_2$ of the exhaust rocker arm 14 are separated from one another by a separation wall $\mathbf{119}_3$. The support body 122 is threaded into the upper reset bore $\mathbf{119}_1$ to engage the separation wall $\mathbf{119}_3$. The support body 122 allows design control over the specific material performance properties of these two connection points (i.e., the bearing surface 122B and the check-valve seat 140), allowing greater flexibility than having these features integrated into the exhaust rocker arm 14, as shown in FIGS. 3A-3C. If such functions and features are integrated into the exhaust rocker arm 14, then the material properties of these connections are restricted to the specific material specification of the exhaust rocker arm 14. Material properties for the separate support body 122, thus, can be adjusted to, for example, increase durability of the two connections in this location, improving overall design robustness. For example, the support body 122 may be a hardened steel material while the exhaust rocker arm 14 may be a cast iron.

The support body 122 is provided with one or more (i.e., at least one) communication ports 123 therethrough. The communication ports 123 are disposed above the check-valve seat 140 of the support body 122, so as to maintain fluid connection of the upper reset bore $\mathbf{19}_1$ with the reset conduit 22R.

Figure 6:
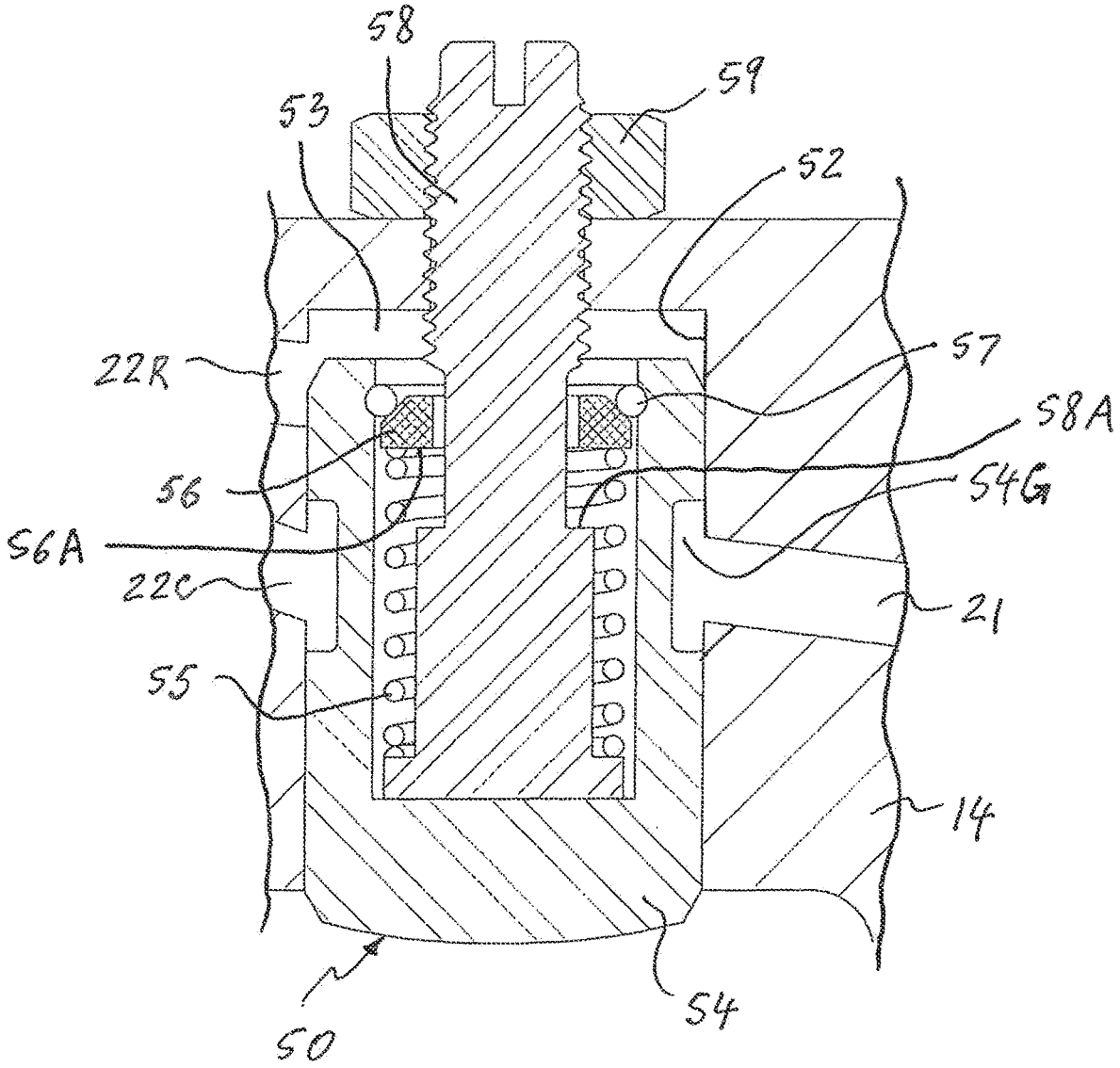
FIG. 6 shows an actuation piston assembly of the compression-release engine brake system according to the first exemplary embodiment of the present invention.

FIG. 6 shows the details of the compression release actuation piston assembly 50 disposed in a cylindrical actuation bore 52 also formed in the exhaust rocker arm 14 and spaced from the cylindrical upper and lower reset bores $\mathbf{19}_1$ and $\mathbf{19}_2$. The actuation piston assembly 50 comprises a cylindrical actuation piston 54 configured to rectilinearly reciprocate within the actuation bore 52 of the exhaust rocker arm 14, and an actuation piston return spring 55 mounted within the actuation piston 54 for biasing the actuation piston 54 in a direction away from the first exhaust valve $\mathbf{2}_1$, also called a brake valve. The cylindrical actuation bore 52 defines an actuation cavity 53 delimited by the actuation piston 54 within the exhaust rocker arm 14 above the actuation piston 54. Hydraulic pressure in the actuation cavity 53 above the actuation piston 54 pushes (or displaces) the actuation piston 54 toward the brake valve $\mathbf{2}_1$. According to the first exemplary embodiment, the actuation piston 54 is provided with an annular groove 54G fluidly connecting the supply conduit 21 with the connecting conduit 22C. Alternatively, the supply conduit 21 and the connecting conduit 22C may be formed as a single continuous conduit that does not intersect the actuation piston 54.

The actuation piston 54 is moveable between retracted and extended positions relative to the actuation bore 52 and is adapted to contact a top end surface of the single-valve actuation thru-pin 5 (best shown in FIG. 1). The single-valve actuation thru-pin 5 is slidably movable relative to the exhaust valve bridge 4 through an opening in the exhaust valve bridge 4. The actuation piston assembly 50 further includes a support washer 56 that supports the actuation piston return spring 55 within the actuation piston 54. The support washer 56 is retained within the actuation piston 54 by a first retaining ring 57, such as an O-ring or C-ring. Preferably, the activation piston assembly 50 further includes an adjustable piston stopper 58 and a lock nut 59 for independent adjustment of the retracted position of the actuation piston 54, i.e., of a clearance between the actuation piston 54 and the brake valve $\mathbf{2}_1$, but this is not required. The support washer 56 further includes a lower surface 56A that can engage a stopping surface 58A of an adjustable piston stopper 58 (best shown in FIG. 6) to limit the extension distance of the actuation piston assembly 50.

FIG. 3B shows the reset check valve 36 in the hydraulic lock position with the brake reset device 20 activated. The slider-piston 24 is partially retracted into the lower reset bore $\mathbf{19}_2$ of the exhaust rocker arm 14, and the reset pin flange 46 of the upset pin 45 is in contact with the spring washer 32. The pressure supplied by the reset conduit 22R from the adjacent actuation cavity 53 above the actuation piston 54 being in contact with the exhaust valve $\mathbf{2}_1$, prevents the valve closing member 38 from rising and unseating the valve closing member 38 from the check-valve seat 40 and, as such, the reset pressure control spring 27 becomes compressed.

Figure 7:
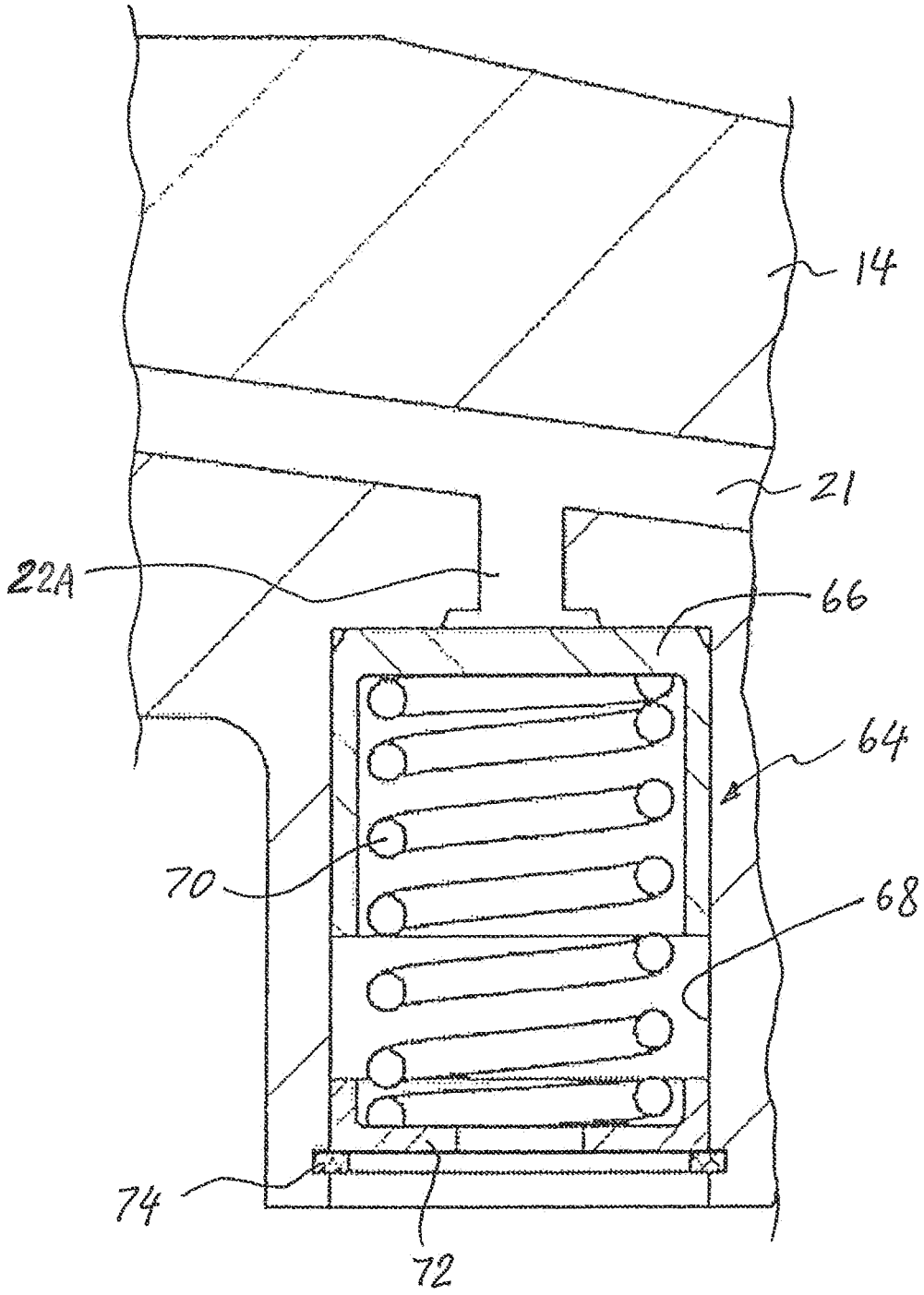
FIG. 7 shows an accumulator device of the compression-release engine brake system according to the first exemplary embodiment of the present invention.

The accumulator device 64, best shown in FIG. 7, is disposed within the exhaust rocker arm 14 (i.e., is integrated into the exhaust rocker arm 14), and arranged in a low-profile inverted orientation, as shown in FIG. 1. The accumulator device 64 supports filling and releasing pressurized hydraulic fluid (e.g., motor oil) from within the engine brake system 10 when in the brake-ON mode of operation. The accumulator device 64 includes an accumulator piston 66 disposed in a cylindrical accumulator bore 68 in the exhaust rocker arm 14, an accumulator pressure control spring 70 biasing the accumulator piston 66 into the exhaust rocker arm 14, and an accumulator cap 72, which acts as an extension limiter for the accumulator piston 66 and is retained within the exhaust rocker arm 14 by a retaining ring 74, such as a C-ring, as best shown in FIG. 7.

The cylindrical accumulator bore 68 defines an accumulator cavity disposed above the accumulator piston 66 within the exhaust rocker arm 14. The accumulator piston 66 rectilinearly reciprocates within the accumulator bore 68. The accumulator bore 68, disposed above the accumulator piston 66, is fluidly connected with an accumulator conduit 22A (best shown in FIGS. 1 and 7). In turn, the accumulator conduit 22A is fluidly connected with the supply conduit 21, as best shown in FIGS. 1 and 7. Hydraulic pressure of the pressurized hydraulic fluid, supplied to the accumulator bore 68 above the accumulator piston 66 through the accumulator conduit 22A, displaces the accumulator piston 66 towards the accumulator cap 72. The accumulator pressure control spring 70 biases the accumulator piston 66, such that the hydraulic fluid discharged from the actuation cavity 53 is stored within the lost motion exhaust rocker assembly 12 at a pressure sufficient to refill the actuation cavity 53 on a subsequent engine cycle. Should the optional accumulator not be present, rapid actuation of the brake-on/brake-off hydraulic fluid function is provided remotely, from another local accumulator type device or pumps/valves, via pressurized fluid through the supply conduit 21.

FIG. 1 illustrates hydraulic connections within the exhaust rocker arm 14. A continuous hydraulic fluid circuit within the exhaust rocker arm 14 is created so that pressurized hydraulic fluid enters through the rocker shaft 16 into the supply conduit 21, the connecting conduit 22C, the accumulator conduit 22A, the accumulator bore 68, the actuation piston assembly 50, and the lower reset bore $\mathbf{19}_2$. The pressurized hydraulic fluid moves through the actuation piston assembly 50 and the brake reset device 20 into the actuation cavity 53 through the reset conduit 22R, which creates the capability to trap the hydraulic fluid between the reset check valve 36 of the brake reset device 20 and the actuation piston 54 of the actuation piston assembly 50. The force required to extend the actuation piston 54 can be provided by an increase in hydraulic pressure between the reset check valve 36 and the actuation piston 54.

In operation of the compression-release engine brake system 10, the pressurized hydraulic fluid is continuously supplied through the supply conduit 21 and the connecting conduit 22C to the lower reset bore $\mathbf{19}_2$ of the brake reset device 20 of the exhaust rocker arm 14 at a pressure lower than that which would extend the actuation piston 54. Engine brake activation is effected by increasing the pressure of the hydraulic fluid in the exhaust rocker assembly 12 above the hydraulic pressure necessary to extend the actuation piston 54 against the bias force of the actuation piston return spring 55 of the actuation piston assembly 50.

The overall engine brake-on/brake-off operation is described hereafter.

The positive power operation, i.e., normal brake-off operation, of the engine is as follows. The supply conduit 21 provides continuous flow of low inlet pressure hydraulic fluid, such as motor oil, to the lower reset bore $\mathbf{19}_2$ through the connecting conduit 22C. The low inlet pressure hydraulic fluid in the lower reset bore $\mathbf{19}_2$ and the external slider bias spring 30 bias the slider-piston 24 with the piston foot 28 downward toward the exhaust valve bridge 4 to maintain consistent contact between the piston foot 28 and the exhaust valve bridge 4. The pressurized engine oil completely fills the actuation cavity 53 of the actuation piston assembly 50 through the open reset check valve 36 and the reset conduit 22R.

In this configuration, as the cam lobe of exhaust valve cam 6 decreases in radius, the slider-piston 24 of the brake reset device 20 will extend outwardly from the exhaust rocker arm 14 to drive the exhaust rocker arm 14 away from the exhaust valve bridge 4, while maintaining constant contact between the piston foot 28 and the exhaust valve bridge 4. The low inlet pressure of the hydraulic fluid is set to a pressure incapable of generating sufficient force to extend the actuation piston 54 against the actuation piston return spring 55 of the actuation piston assembly 50. The combined force applied to extend the slider-piston 24 by the slider bias spring 30 and the regulated hydraulic fluid pressure will never exceed the retaining force of the exhaust valve springs $\mathbf{3}_1$ and $\mathbf{3}_2$ such that, as the exhaust rocker arm 14 is pivoted toward the exhaust valve bridge 4 by increasing radius of the cam lobe of the exhaust valve cam 6, the slider-piston 24 is retracted with respect to the exhaust rocker arm 14. During normal exhaust cam lift by the engine exhaust cam profile $\mathbf{7}_1$ of the exhaust valve cam 6, the slider-piston 24 is driven further into the exhaust rocker arm 14, taking up all lash, until the proximal end $\mathbf{24}_2$ of the slider-piston 24 contacts the separation wall $\mathbf{19}_3$ of the exhaust rocker arm 14, thus placing the slider-piston 24 in the fully retracted position and allowing the lost motion exhaust rocker assembly 12 to open the exhaust valves $\mathbf{2}_1$ and $\mathbf{2}_2$.

In the fully retracted position of the slider-piston 24, best shown in FIG. 3A, the sealing portion 44 of the valve closing member 38 is lifted off the check-valve seat 40 (to an open position of the reset check valve 36 by the upset pin 45). Specifically, the upset pin 45 lifts, through the resilient biasing action of the pressure control spring 27 and the spring washer 32 engaging the flange 46 of the upset pin 45, and holds the sealing portion 44 of the valve closing member 38 off the check-valve seat 40.

To start the engine brake-on mode, continuous flow of a full (or high) inlet pressure hydraulic fluid is provided through the supply conduit 21 and the connecting conduit 22C to the lower reset bore $\mathbf{19}_2$ of the brake reset device 20. The highly pressurized engine oil is supplied to the actuation cavity 53 of the actuation piston assembly 50 through the open reset check valve 36 and the reset conduit 22R. The full inlet pressure within the actuation cavity 53 of the exhaust rocker arm 14 generates sufficient force to extend the actuation piston 54 against the biasing force of the actuation piston return spring 55, but still insufficient, by itself, to overcome the retaining forces of the exhaust valve $2_1$ such as the exhaust valve spring $3_1$ and engine gas pressures acting on the exhaust valve $2_1$.

The slider-piston 24 will continue to behave as in normal brake-off mode, whereas the actuation piston 54, on the other hand, will now extend from the actuation bore 52 of the exhaust rocker arm 14 until the actuation piston 54 comes into contact with the single-valve actuation thru-pin 5. The cam lobe of the exhaust valve cam 6 will fall to lower base circle $8_1$ prior to the pre-charge lift profile $7_3$ or the engine brake lift profile $7_2$, allowing the exhaust rocker arm 14 to rotate away from the exhaust valve bridge 4. The lower base circle $8_1$ is a point of a lowest cam radius. At this point the exhaust rocker arm 14 will be rotated furthest from the exhaust valve bridge 4, allowing the actuation piston 54 to be at maximum extension from the exhaust rocker arm 14. In this state, the proximal end $24_2$ of the slider-piston 24 is farthest from the separation wall $19_3$ of the exhaust rocker arm 14 and the check-valve seat 40 (i.e., the slider-piston 24 is in the fully extended position thereof), as shown in FIG. 3C.

Then, the hydraulic fluid will be trapped within both the actuation cavity 53 and the reset conduit 22R. Consequently, hydraulic pressure will be built sufficiently within the actuation cavity 53 to maintain extension of the actuation piston 54 from the exhaust rocker arm 14, moving the single-valve thru-pin 5 and opening the exhaust valve $2_1$ for pre-charge or compression release. Accordingly, when the actuation piston 54 presses the single-valve thru-pin 5 towards the first exhaust valve $2_1$ just prior to TDC of the compression stroke during the compression-release engine braking event, the fluid pressure in the actuating cavity 53 and the reset conduit 22R become higher than the fluid pressure in the upper and lower reset bores $19_1$ and $19_2$, thus forcing the sealing portion 44 of the valve closing member 38 of the reset check valve 36 to be seated on the check-valve seat 40, and thus hydraulically locking the engine oil (hydraulic fluid) in the actuating cavity 53, as shown in FIGS. 3B and 3C.

The cam lobe of the exhaust valve cam 6 will rise as it enters the pre-charge lift profile $7_3$ or the engine brake lift profile $7_2$, which will rotate the exhaust rocker arm 14 back toward the exhaust valve bridge 4 and the force of the engine cylinder pressure acting on the face of the first exhaust valve $2_1$ and the first exhaust valve spring $3_1$ will attempt to retract the actuation piston 54 into the actuation bore 52 of the exhaust rocker arm 14 to maintain the closed position of the first exhaust valve $2_1$. The actuation piston 54 will not be retracted, however. Instead, the trapped hydraulic oil within the actuation cavity 53 and reset conduit 22R will increase in pressure to support the force, and the single exhaust valve $2_1$ will be opened according to the cam lift profile.

During the opening of the single exhaust valve $2_1$ with the single-valve thru-pin 5, the cylinder pressure is increasing and rapidly reaches peak cylinder pressure just prior to TDC compression, and then cylinder pressure drops rapidly just after TDC compression. Because of the compression release near TDC and the engine piston in the cylinder moving downwardly in the engine cylinder, the cylinder pressure decreases rapidly and so does the pressure in the actuation cavity 53.

Resetting of the first exhaust valve $2_1$ is effected as the exhaust valve cam 6 rises to the upper base upper base circle $8_2$. The forward motion (or clockwise pivoting) of the exhaust rocker arm 14 causes the slider-piston 24 to retract into the lower reset bore $19_2$ of the exhaust rocker arm 14, consequently moves the valve closing member 38 with the upset pin 45 of the reset check valve 36 out of engagement with the check-valve seat 40. During a compression release event, the engine cylinder pressure continues to increase as the first exhaust valve $2_1$ opens, which in turn acts on a face of the first exhaust valve $2_1$ to create a force on the actuation piston 54 through the single-valve thru-pin 5, thus increasing the hydraulic pressure in the actuation cavity 53 of the exhaust rocker arm 14.

During the actual engine compression release event, when the engine brake lift profile $7_2$ of the exhaust valve cam 6 acts on the exhaust rocker arm 14, the engine cylinder pressure is high. Although the slider-piston 24 is retracted far enough for the upset pin 45 to move the sealing portion 44 of the valve closing member 38 of the reset check valve 36 away from the check-valve seat 40, the sealing portion 44 of the valve closing member 38 is not lifted from the check-valve seat 40, i.e., the reset check valve 36 is not open. Instead, the spring washer 32 is displaced within the slider-piston 24 to compress the reset pressure control spring 27, as shown in FIG. 3C, until the engine cylinder pressure falls to a value where the force created by the hydraulic pressure in the actuation cavity 53 is less than the force generated by the reset pressure control spring 27, and the sealing portion 44 of the valve closing member 38 of the reset check valve 36 is lifted from the check-valve seat 40 by the upset pin 45, i.e., the reset check valve 36 is open. When the reset check valve 36 is open, the hydraulic pressure in the actuation cavity 53 rapidly falls. Subsequently, the force on the actuation piston 54 due to the hydraulic pressure in the actuation cavity 53 falls to a value that cannot sustain lift of the first exhaust valve $2_1$ against the combined force of the first exhaust valve spring $3_1$ and the engine cylinder pressure, the first exhaust valve $2_1$ returns to the closed position.

During the resetting of the first exhaust valve $2_1$, a portion of the hydraulic fluid in the actuation cavity 53 is discharged in order to facilitate retraction of the actuation piston 54 into the actuation bore 52 of the exhaust rocker arm 14. The optional accumulator device 64 manages the discharged hydraulic fluid from the exhaust rocker arm 14 to aid the hydraulic performance of the rocker arm compression-release engine brake system 10. In the presence of sufficient hydraulic pressure, the accumulator piston 66 moves towards the accumulator cap 72 to increase the volume of the accumulator cavity in the accumulator bore 68, which is fluidly connected with the accumulator conduit 22A, and compresses the accumulator pressure control spring 70, allowing the hydraulic fluid to be stored within the accumulator cavity at a predetermined pressure. When the exhaust valve cam 6 rotates to the lower base circle $8_1$, the accumulator pressure control spring 70 extends to force the displacement of the accumulator piston 66 towards the retracted position, driving the stored hydraulic fluid into the accumulator conduit 22A and the actuation cavity 53, helping to re-extend the actuation piston 54 (i.e., displacing the actuation piston 54 toward the extended position, or toward the first exhaust valve $2_1$).

The engine cylinder pressure, at which reset of the first exhaust valve $2_1$ occurs, is tunable by adjusting the active forces of the reset pressure control spring 27. The tuning capability of the exhaust valve reset creates a reset that initiates early in the expansion stroke to ensure that the exhaust valve is closed prior to a start of a normal exhaust valve motion defined by the normal exhaust cam profile $7_1$ of the exhaust valve cam 6.

Various modifications, changes, and alterations may be practiced with the above-described embodiment, including but not limited to the additional embodiments shown in FIGS. 8-13. In the interest of brevity, reference characters that are discussed above in connection with FIGS. FIGS. 1-8 are not further elaborated upon below, except to the extent necessary or useful to explain the additional embodiment of FIGS. 8-13.

Figure 8:
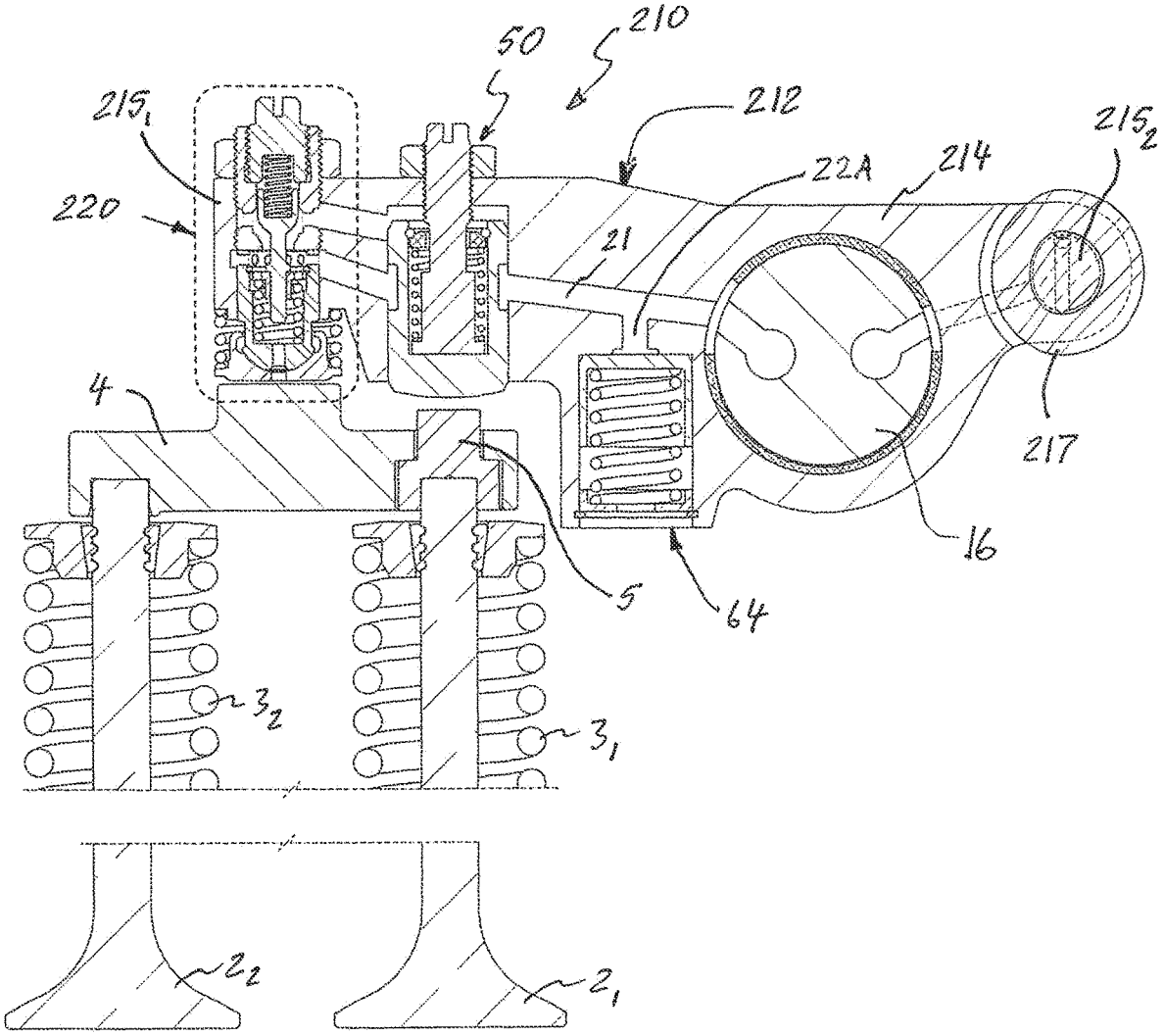
FIG. 8 shows a sectional view of a low-profile compression-release engine brake system according to a second exemplary embodiment of the present invention.
Figure 9:
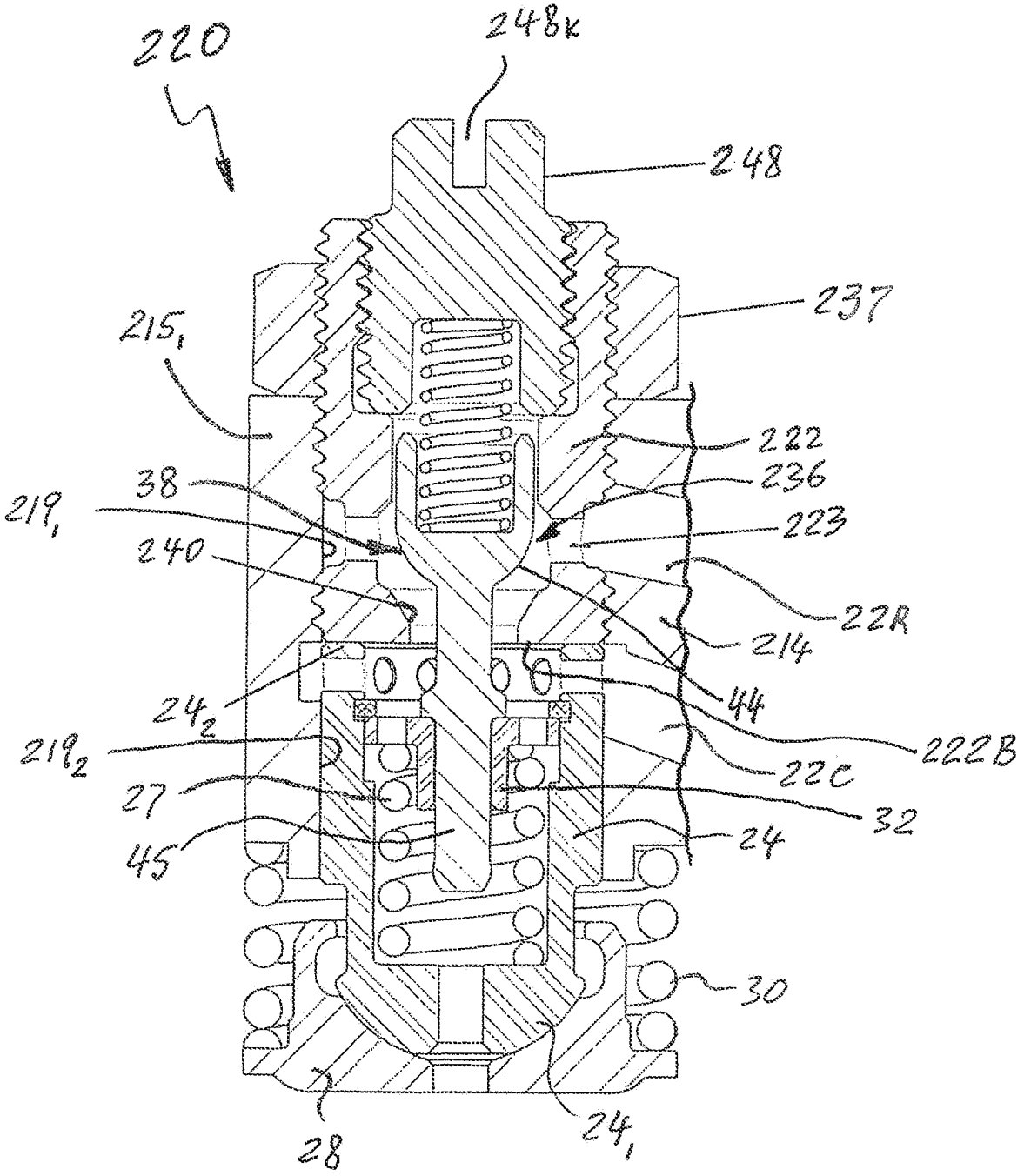
FIG. 9 shows a low-profile brake reset device according to the second exemplary embodiment of the present invention.

FIGS. 8-9 illustrate a second exemplary embodiment of a compression-release engine brake system, generally depicted by the reference character 210. Components which are unchanged from the previous exemplary embodiments of the present invention are labeled with the same reference characters. Components which function in the same way as in the first exemplary embodiment of the present invention depicted in FIGS. 1-5 are designated by the same reference numerals to which 200 or 100 has been added, sometimes without being described in detail since similarities between the corresponding parts in the two embodiments will be readily perceived by the reader.

The compression-release engine brake system 210 according to the second exemplary embodiment, illustrated in FIG. 8, includes a lost motion exhaust rocker assembly 212 for operating at least one of the first exhaust valve $\mathbf{2}_1$ and the second exhaust valve $\mathbf{2}_2$. The lost motion exhaust rocker assembly 212 includes an exhaust rocker arm 214 pivotally mounted about a rocker shaft 16 to open the first and second exhaust valves $\mathbf{2}_1$ and $\mathbf{2}_2$ through the exhaust valve bridge 4. The rocker shaft 16 extends through a rocker arm bore formed in the exhaust rocker arm 214 (as best shown in FIG. 8). The exhaust rocker arm 214, as best shown in FIG. 8, has two ends: a driving (first distal) end $\mathbf{215}_1$ controlling the engine exhaust valves $\mathbf{2}_1$ and $\mathbf{2}_2$, and a driven (second distal) end $\mathbf{215}_2$. The rocker assembly 212 is configured for an overhead camshaft engine, and includes a cylindrical exhaust roller-follower 217 rotatably mounted to the driven end $\mathbf{215}_2$ of the exhaust rocker arm 214 for direct camshaft action. The roller-follower 217 is adapted to contact the exhaust cam profile $\mathbf{7}_1$, the engine brake lift profile $\mathbf{7}_2$ and the pre-charge lift profile $\mathbf{7}_3$ of the exhaust valve cam 6. The exhaust roller-follower 217 defines a camshaft interface. Alternatively, the camshaft interface may be adapted to suit engine requirements, for example with a ball or socket for a push-rod type interface.

The lost motion exhaust rocker assembly 212 further includes a low-profile brake reset device 220, an actuation piston assembly 50, and an accumulator device 64, all mounted to the exhaust rocker arm 214. The low-profile brake reset device 220 is disposed above the exhaust valve bridge 4 in the driving end $\mathbf{215}_1$ of the exhaust rocker arm 214. Moreover, the exhaust rocker arm 214 has a supply conduit 21, a connecting conduit 22C and a reset conduit 22R, all formed within the exhaust rocker arm 214, as best shown in FIG. 8.

Components of the brake reset device 220, which are unchanged from the first exemplary embodiment of the present invention, are labeled with the same reference characters. Components, which function in the same way as in the first exemplary embodiment of the present invention depicted in FIGS. 1 and 3A-3C are designated by the same reference numerals to some of which 100 has been added, sometimes without being described in detail since similarities between the corresponding parts in the two embodiments will be readily perceived by the reader.

The low-profile brake reset device 220, as best shown in FIG. 9, includes a support body 222 disposed in a cylindrical upper reset bore $\mathbf{219}_1$ formed in the exhaust rocker arm 214 and closed from the top by a plug 248, which is firmly secured to the support body 222 for example by threaded connection. The low-profile brake reset device is adjustable relative to the exhaust rocker arm 214 and removably threaded to the driving end $\mathbf{215}_1$ of the exhaust rocker arm 214. The low-profile brake reset device 220 comprises a hollow slider-piston 24 that rectilinearly reciprocates within cylindrical lower reset bore $\mathbf{219}_2$ formed in the exhaust rocker arm 214 beneath the upper reset bore $\mathbf{219}_1$, and a reset check valve 36.

The hollow slider-piston 24 rectilinearly reciprocates within the lower reset bore $\mathbf{219}_2$ formed in the exhaust rocker arm 214, as shown in FIG. 9. The support body 222 has a cylindrical outer peripheral surface at least partially threaded into the upper reset bore $\mathbf{219}_1$ so as to be threadedly received in the partially internally threaded upper reset bore $\mathbf{219}_1$ in the driving end $\mathbf{215}_1$ of the exhaust rocker arm 214. The threaded support body 222 is adjustable (i.e., moveable) relative to the exhaust rocker arm 214 within the upper reset bore $\mathbf{219}_1$. A locking nut 237 is threaded into the threaded support body 222 to maintain the lash setting of the engine brake during engine operation. In the above configuration, the threaded support body 222 is integrally formed with an internal check-valve seat 240 and a bearing surface 222B for engagement with the corresponding reset components, such as the slider-piston 24. The plug 248 has an engagement feature 248*k*, for example a slot or hex, used by the operator during lash adjustment. The plug 248 seals the contained fluid chamber from above and provide a means for lash adjustment of the device. Thus, the brake reset device 220 is adjustable relative to the exhaust rocker arm 214, with external threading and the locking nut 237 for proper setting and control of valvetrain lash.

The support body 222 has one or more (i.e., at least one) communication ports 223 therethrough. The communication ports 223 are disposed above the check-valve seat 240 of the support body 222 to maintain fluid connection of the upper reset bore $\mathbf{219}_1$ with the reset conduit 22R for all positions of the slider-piston 24.

Figure 10:
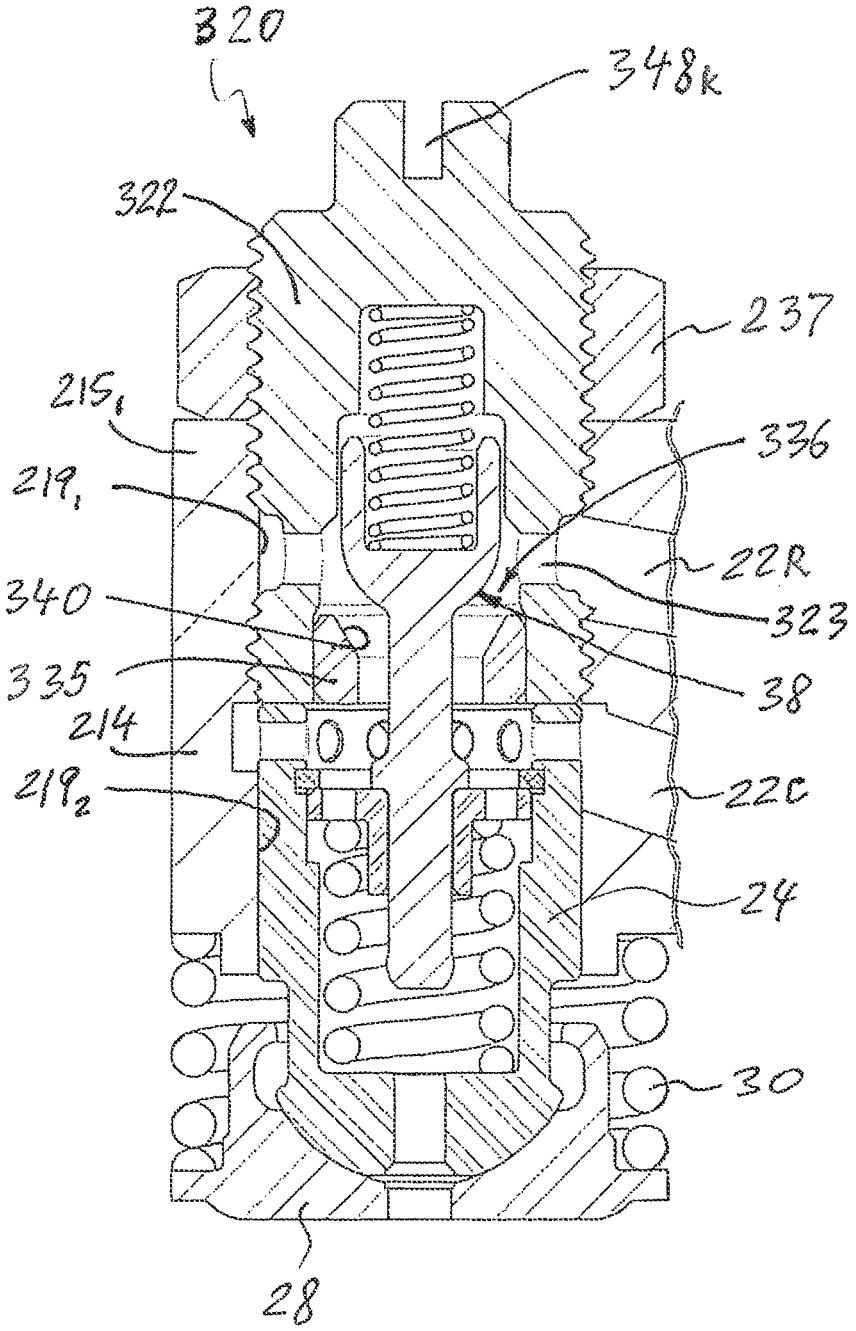
FIG. 10 shows an alternative embodiment of the low-profile brake reset device of the compression-release engine brake system according to the second exemplary embodiment of the present invention.

FIG. 10 illustrates an alternative exemplary embodiment of a low-profile brake reset device, generally depicted by the reference numeral 320. Components which are unchanged from the second exemplary embodiment of the brake reset device are labeled with the same reference characters. Components which function in the same way as in the second exemplary embodiment depicted in FIG. 9 are designated by the same reference numerals to some of which 100 has been added, sometimes without being described in detail since similarities between the corresponding parts in the two embodiments will be readily perceived by the reader.

The low-profile brake reset device 320 of FIG. 10 comprises a support body 322 having a cylindrical outer peripheral surface at least partially threaded into the upper reset bore $\mathbf{219}_1$ so as to be threadedly received in the partially internally threaded upper reset bore $\mathbf{219}_1$ in the driving end $\mathbf{215}_1$ of the exhaust rocker arm 214. The hollow slider-piston 24 rectilinearly reciprocates within the lower reset bore $\mathbf{219}_2$ formed in the exhaust rocker arm 14, and a reset check valve 336, as shown in FIG. 10. The support body 322 has one or more (i.e., at least one) communication ports 323 therethrough.

Unlike the brake reset device 220 of the second exemplary embodiment, the brake reset device 320 is configured without a threaded plug. Instead, an engagement feature 348*k* is integrated into the threaded support body 322 of the brake reset device 320. The brake reset device 320 includes a check-valve seat member 335 as a separate component, that is fixedly (i.e., non-moveably) connected to the threaded support body 322, allowing, as above, for optional material selection for the check-valve seat member 335. The check-valve seat member 335 is force-fit (interference fit) into the support body 322, or otherwise secured with an additional retaining means. The check-valve seat member 335 is formed with a check-valve seat 340, as best shown in FIG. 10. The communication ports 323 are disposed above the check-valve seat member 335 to maintain fluid connection of the upper reset bore $\mathbf{219}_1$ with the reset conduit 22R for all positions of the slider-piston 24. A locking nut 237 is threaded into the threaded support body 322 for fixing the threaded support body 322 within the upper reset bore $\mathbf{219}_1$ of the exhaust rocker arm 214.

Figure 11:
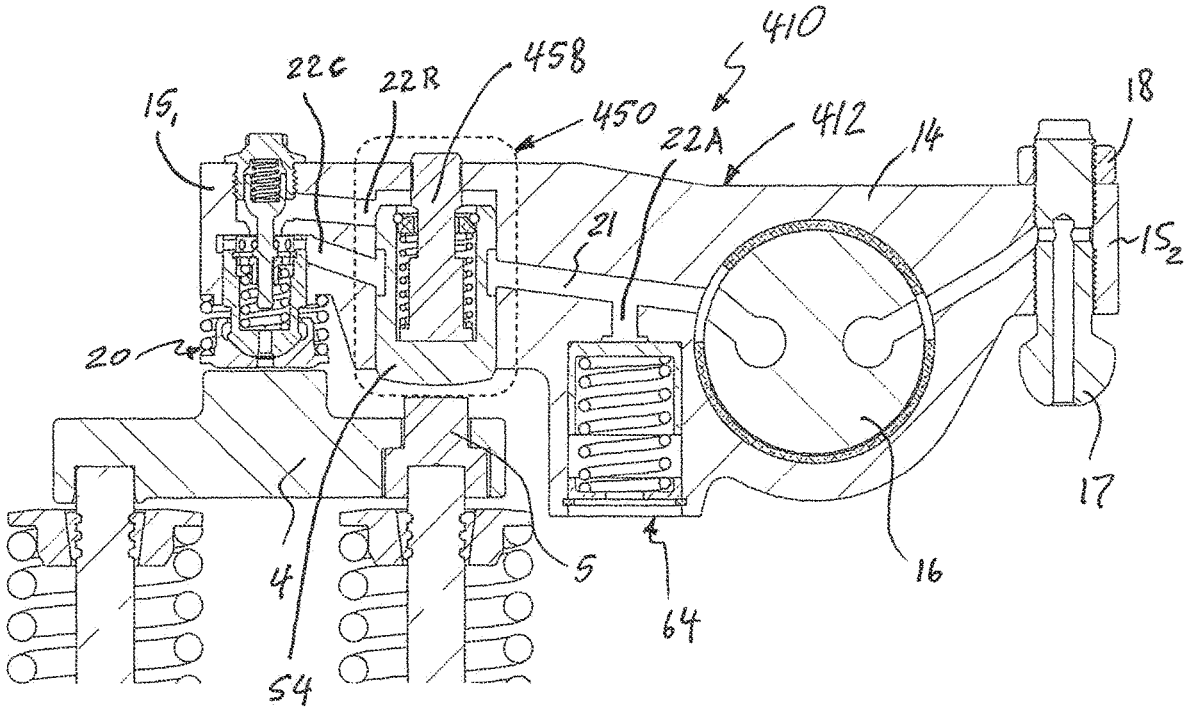
FIG. 11 shows a sectional view of a low-profile compression-release engine brake system according to a third exemplary embodiment of the present invention.

FIG. 11 illustrates a third exemplary embodiment of a compression-release engine brake system, generally depicted by the reference character 410. Components which are unchanged from the previous exemplary embodiments of the present invention are labeled with the same reference characters. Components which function in the same way as in the first exemplary embodiment depicted in FIGS. 1-7 are designated by the same reference numerals to which 400 has been added, sometimes without being described in detail since similarities between the corresponding parts in the two embodiments will be readily perceived by the reader.

The compression-release engine brake system 410 according to the third exemplary embodiment illustrated in FIG. 11 includes an actuation piston assembly 450 with a non-adjustable brake actuation piston 54. Specifically, the actuation piston assembly 450 includes a brake actuation piston 54 moveable between retracted and extended positions relative to the exhaust rocker arm 14, and a piston stopper 458 for restricting the retracted position of the actuation piston 54. Unlike the actuation piston assembly 50 of the first exemplary embodiment, the piston stopper 458 is non-adjustable. The normal lash with the thru-pin 5 is controlled through design clearance, and the brake actuation piston 54 is designed such to have sufficient stroke to account for a range of lash values.

Figure 12:
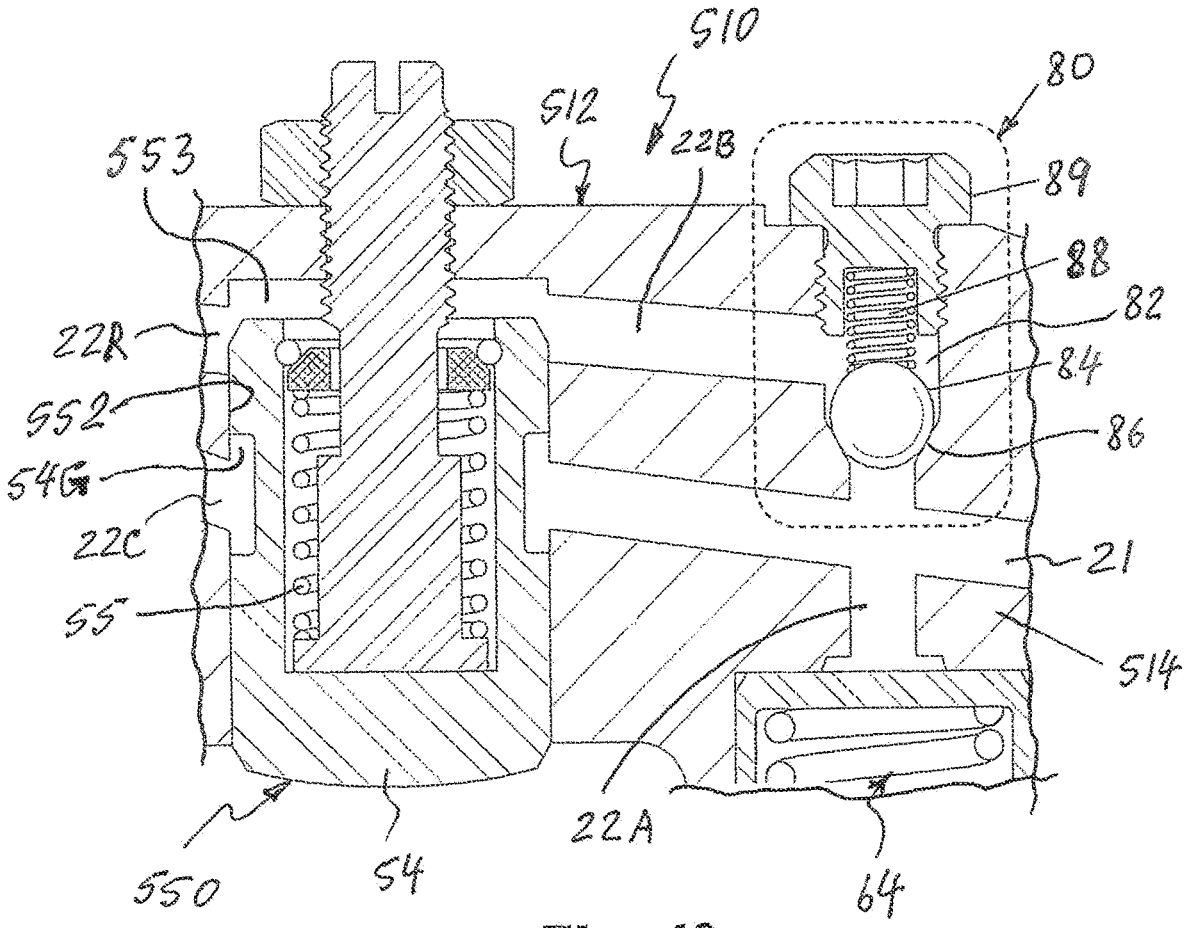
FIG. 12 shows a partial sectional view of a low-profile compression-release engine brake system according to a fourth exemplary embodiment of the present invention.

FIG. 12 illustrates a fourth exemplary embodiment of a compression-release engine brake system, generally depicted by the reference character 510. Components which are unchanged from the previous exemplary embodiments of the present invention are labeled with the same reference characters. Components which function in the same way as in the first exemplary embodiment depicted in FIGS. 1-7 are designated by the same reference numerals to which 500 has been added, sometimes without being described in detail since similarities between the corresponding parts in the two embodiments will be readily perceived by the reader.

The compression-release engine brake system 510 according to the fourth exemplary embodiment illustrated in FIG. 12, includes a lost motion exhaust rocker assembly 512 including an exhaust rocker arm 514 pivotally mounted about the rocker shaft 16 to open the first and second exhaust valves $\mathbf{2}_1$ and $\mathbf{2}_2$ through the exhaust valve bridge 4, and a compression-release actuation piston assembly 550.

The actuation piston assembly 550 includes a cylindrical actuation piston 54 that rectilinearly reciprocates within actuation bore 552 of the exhaust rocker arm 514. Actuation piston return spring 55 is mounted within the actuation piston 54 for biasing the actuation piston 54 in a direction away from the brake valve $\mathbf{2}_1$. The cylindrical actuation bore 552 defines an actuation cavity 553 delimited by the actuation piston 54 within the exhaust rocker arm 514 above the actuation piston 54. Hydraulic pressure in the actuation cavity 553 above the actuation piston 54 pushes (or displaces) the actuation piston 54 toward the brake valve $\mathbf{2}_1$. The actuation piston 54 has an annular groove 54G fluidly connecting the supply conduit 21 with the connecting conduit 22C.

As shown in FIG. 12, the exhaust rocker assembly 512 further comprises a supplemental check valve 80 integrated into the exhaust rocker arm 514 and disposed in a supplemental valve cavity 82 formed within the exhaust rocker arm 514. The supplemental check valve 80 is separate and spaced from the brake reset device 20, 120, 220 or 320, the compression-release actuation piston assembly 550, and the accumulator device 64. The supplemental valve cavity 82 is separate and spaced from the reset valve cavity $\mathbf{29}_1$ and the slider-piston cavity $\mathbf{29}_2$ of the brake reset device 20, the actuation cavity 553 of the actuation piston assembly 550, and the accumulator cavity defined by the accumulator bore 68.

The supplemental check valve 80 includes a moveable sealing member 84, such as a ball-valve member 84, disposed in the valve cavity 82 and lands on a check-valve seat 86 formed in the valve cavity 82, a biasing spring 88, and a spring cap 89, as shown in FIG. 12. The supplemental check valve 80 is configured to move between a closed position and an open position to provide a unidirectional (i.e., one-way) hydraulic fluid flow pathway from the supply conduit 21 to brake conduit 22B fluidly connecting actuation cavity 553 of the compression-release actuation piston assembly 550 to the supply conduit 21 in the exhaust rocker arm 514, thus bypassing the brake reset device 20, 120, 220 or 320. The biasing spring 88 biases the sealing member 84 into the closed position of the supplemental check valve 80. In the exemplary embodiment shown in FIG. 12, the sealing member 84 is in the form of a ball, which forms a seal against the exhaust rocker arm 514 when the supplemental check valve 80 is closed.

Figure 13:
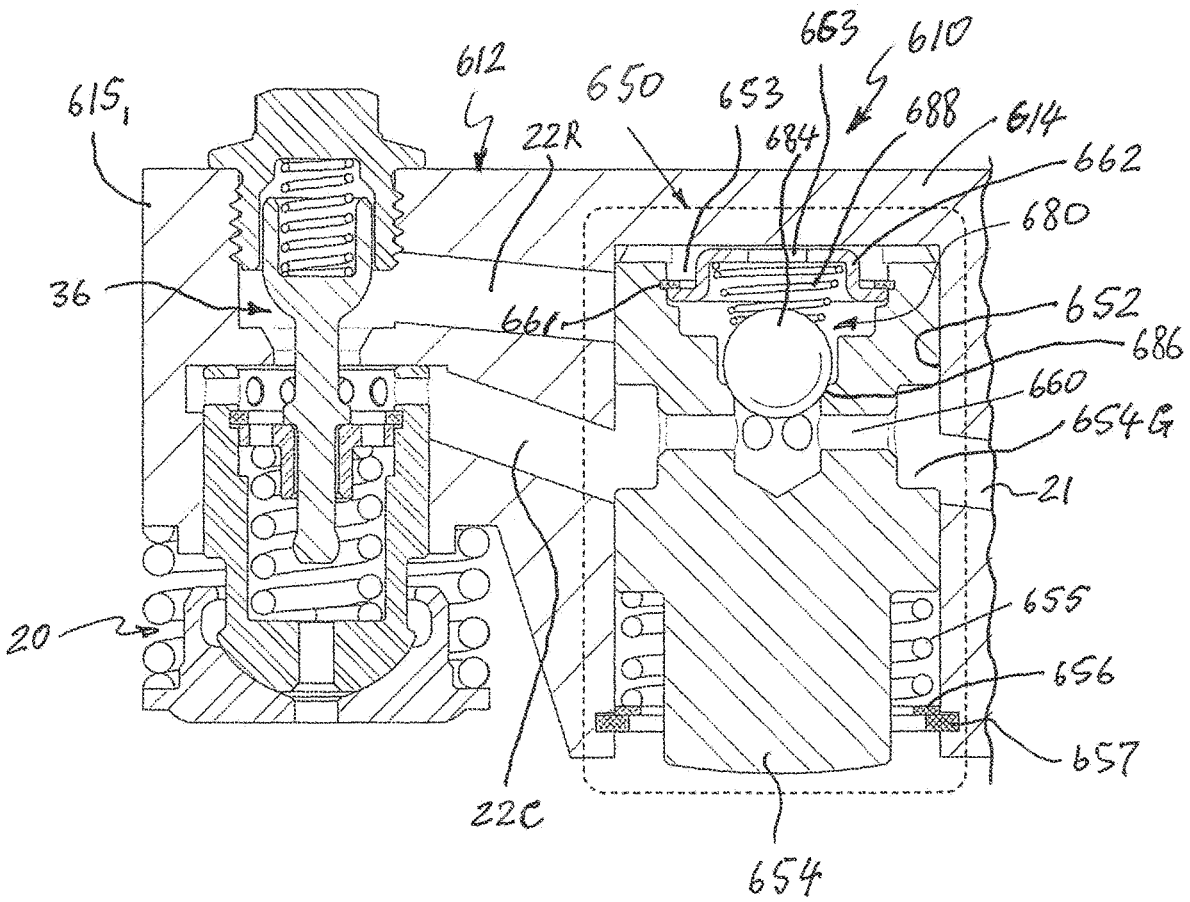
FIG. 13 shows a partial sectional view of a low-profile compression-release engine brake system according to a fifth exemplary embodiment of the present invention.

FIG. 13 illustrates a fifth exemplary embodiment of a compression-release engine brake system, generally depicted by the reference character 610. Components which are unchanged from the previous exemplary embodiments of the present invention are labeled with the same reference characters. Components which function in the same way as in the first exemplary embodiment depicted in FIGS. 1-7 are designated by the same reference numerals to which 600 has been added, sometimes without being described in detail since similarities between the corresponding parts in the two embodiments will be readily perceived by the reader.

The compression-release engine brake system 610 according to the fifth exemplary embodiment illustrated in FIG. 13 includes a lost motion exhaust rocker assembly 612 including an exhaust rocker arm 614 pivotally mounted about the rocker shaft 16 to open the first and second exhaust valves $\mathbf{2}_1$ and $\mathbf{2}_2$ through the exhaust valve bridge 4, and a compression-release actuation piston assembly 650. The actuation piston assembly 650 includes a cylindrical actuation piston 654 that rectilinearly reciprocates within cylindrical actuation bore 652 of the exhaust rocker arm 514, and an actuation piston return spring 655 mounted around the actuation piston 654 for biasing the actuation piston 654 in a direction away from the brake valve $\mathbf{2}_1$. The cylindrical actuation bore 652 defines an actuation cavity 653 delimited by the actuation piston 654 within the exhaust rocker arm 614 above the actuation piston 654.

The actuation piston assembly 650 further comprises a support washer 656 that provides an extension limiter for the actuation piston 654 and supports the actuation piston return spring 655 around the actuation piston 654. The support washer 656 is retained within the actuation bore 652 by a piston retaining ring 657, such as a C-ring. The actuation piston 654 has one or more (i.e., at least one) actuator ports 660 therethrough for fluidly connecting the supply conduit 21 with the connecting conduit 22C. Hydraulic pressure in the actuation cavity 653 above the actuation piston 654 pushes (or displaces) the actuation piston 654 toward the brake valve $\mathbf{2}_1$. The actuation piston 654 has an annular groove 654G fluidly connecting the supply conduit 21 with the connecting conduit 22C through the actuator ports 660.

As shown in FIG. 13, the actuation piston assembly 650 further includes a supplemental check valve 680 integrated into and disposed within the actuation piston 654. The supplemental check valve 680 moves between a closed position and an open position to provide a unidirectional (i.e., one-way) hydraulic fluid flow pathway fluidly connecting the supply conduit 21 to the actuation cavity 653. The supplemental check valve 680 includes a moveable sealing member 684, such as a ball-valve member 684, disposed in the actuation piston 654 and lands on a check-valve seat 686 formed in the actuation piston 654, a biasing spring (or check spring) 688, and a spring cap 662, as shown in FIG. 13. The spring cap 662 and the biasing spring 688 are retained in the actuation piston 654 by a valve retaining ring 661, such as a C-ring. The spring cap 662 has at least one opening 663 therethrough fluidly connecting the actuation cavity 653, and thus the reset conduit 22R, with the actuator ports 660 of the actuation piston 654, the supply conduit 21 and the connecting conduit 22C, through the supplemental check valve 680. The supplemental check valve 680 selectively fluidly connects and disconnects the reset conduit 22R with the connecting conduit 22C and the supply conduit 21. Thus, the brake reset device 20 is operatively connected to the actuation piston assembly 650 through the connecting conduit 22C and the reset conduit 22R of the exhaust rocker arm 614. The supplemental check valve 680 allows one-way flow from the supply conduit 21 and the connecting conduit 22C to the reset conduit 22R via the actuator ports 660 within the actuation piston 654. In the exemplary embodiment shown in FIG. 12, the sealing member 684 is in the form of a ball, which seals the actuation cavity 653 when the supplemental check valve 680 is closed. The biasing spring (or check spring) 688 biases the ball-valve member 684 into the closed position of the supplemental check valve 680.

Moreover, the actuation piston 654 utilizes the actuation piston return spring 655 to maintain a retracted position during the brake-OFF mode, and allows the actuation piston 654 to extend from the actuation bore 652 during the brake-ON mode. The fluid pressure in the reset conduit 22R is increased during the brake-ON mode. The fluid pressure applies a force onto an upper surface of the actuation piston 654 and urges the actuation piston 654 against the actuation piston return spring 655, causing the actuation piston return spring 655 to compress and the actuation piston 654 to extend.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A lost motion exhaust rocker assembly for effectuating a compression-release engine braking operation in connection with an internal combustion engine including at least one exhaust valve and at least one exhaust valve spring exerting a closing force on the at least one exhaust valve to urge the at least one exhaust valve into a closed position, the engine performing a four stroke piston cycle including an intake stroke, a compression stroke, an expansion stroke, and an exhaust stroke, the lost motion exhaust rocker assembly comprising:

an exhaust rocker arm;

an actuation device including an actuation piston slidably disposed in an actuation bore formed in the exhaust rocker arm, the actuation piston configured to be moved from a retracted position to an extended position so as to selectively unseat the at least one exhaust valve from the closed position; and a reset device disposed in a reset bore in the exhaust rocker arm, the reset device including:

a slider-piston slidably disposed in the reset bore, the slider-piston configured to switch between an extended position and a retracted position, a reset check valve operatively connected to the slider-piston, the reset check valve configured to switch between a closed position and an open position, a reset pressure control spring disposed within the slider-piston, and an external slider bias spring disposed around the slider-piston at a position outside of the reset bore, the external slider bias spring configured to bias the slider-piston toward the extended position so as to engage the at least one exhaust valve;

wherein an actuation cavity is defined within the actuation bore above the actuation piston;

wherein the reset bore is in fluid communication with the actuation cavity via a reset conduit within the exhaust rocker arm;

wherein the reset check valve is configured to lock hydraulic fluid in the actuation cavity when the reset check valve is in the closed position, and to enable the hydraulic fluid to flow bi-directionally through the reset check valve when the reset check valve is in the open position;

wherein the reset check valve is biased toward the open position via the reset pressure control spring;

wherein the reset check valve moves toward the closed position when the slider-piston is in the extended position, and the reset check valve moves toward the open position when the slider-piston is in the retracted position; and wherein the slider-piston is operatively associated with a stop member such that the slider-piston is in the extended position when the exhaust rocker arm is furthest away from the stop member, and the slider-piston is moved toward the retracted position as the exhaust rocker arm rotates toward the stop member.

2. The lost motion exhaust rocker assembly as defined in claim 1, wherein the reset check valve includes:

a check valve seat defining a central opening, and a valve closing member including an upper end defining a sealing portion operatively associated with the check valve seat, and an upset pin extending through the central opening from the sealing portion toward a lower end of the valve closing member, the upset pin partially disposed in the slider-piston, wherein the valve closing member is configured to rectilinearly reciprocate within the reset bore.

3. The lost motion exhaust rocker assembly as defined in claim 2, wherein the reset device further includes:

a spring washer slidably mounted within the slider-piston about the upset pin, the spring washer configured to axially support the reset pressure control spring, and a retaining ring disposed within the slider-piston, the retaining ring configured to retain the spring washer and the reset pressure control spring within the slider-piston, wherein the spring washer is further configured to move relative to the upset pin, and wherein the upset pin includes a reset pin flange configured to engage the spring washer.

4. The lost motion exhaust rocker assembly as defined in claim 3, wherein:

the slider-piston moves away from the check valve seat so as to maintain the reset check valve in the closed position when hydraulic pressure within the actuation cavity acting on the reset check valve is greater than a biasing force of the reset pressure control spring, and the slider-piston moves toward the check valve seat so as to open the reset check valve when the hydraulic pressure within the actuation cavity acting on the reset check valve is less than the biasing force of the reset pressure control spring.

5. The lost motion exhaust rocker assembly as defined in claim 3, wherein, during a brake-on mode of the internal combustion engine, the compression-release engine braking operation includes supplying hydraulic fluid to the actuation device at a pressure sufficient to displace the actuation piston to the extended position such that:

after a normal exhaust valve motion ends, the actuation piston moves toward the extended position so as to engage the at least one exhaust valve as the exhaust rocker arm rotates away from the stop member, and the reset check valve moves toward the closed position so as to trap the hydraulic fluid within the actuation cavity, during the compression stroke, a pressure of the trapped hydraulic fluid becomes sufficient to cause a compression-release event in which the actuation piston unseats the at least one exhaust valve from the closed position as the exhaust rocker arm rotates toward the stop member, after the compression release event, the reset pressure control spring moves the reset check valve into the open position so as to release a portion of the hydraulic fluid within the actuation cavity such that the at least one exhaust valve moves toward the closed position via a biasing force of the at least one exhaust valve spring.

6. The lost motion exhaust rocker assembly as defined in claim 5, wherein a biasing force of the reset pressure control spring enables the at least one exhaust valve to return to the closed position during the expansion stroke prior to the normal exhaust valve motion of each engine cycle.

7. The lost motion exhaust rocker assembly as defined in claim 5, wherein during the intake stroke, the pressure of the trapped hydraulic fluid becomes sufficient to cause the actuation piston to unseat the at least one exhaust valve from the closed position as the exhaust rocker arm rotates toward the stop member, and wherein the at least one exhaust valve returns to the closed position prior to the compression release event.

8. The lost motion exhaust rocker assembly as defined in claim 3, wherein the upset pin further includes a retention section disposed at the lower end of the valve closing member, the retention section is configured to retain the spring washer on the upset pin.

9. The lost motion exhaust rocker assembly as defined in claim 8, wherein the retention section is one of an enlarged portion integrally formed with the upset pin, a retaining clip mounted to the upset pin, a round retainer mounted to the upset pin, and an interference sleeve mounted to the upset pin.

10. The lost motion exhaust rocker assembly as defined in claim 2, wherein the check valve seat is defined by the reset bore.

11. The lost motion exhaust rocker assembly as defined in claim 2, wherein the reset device further includes a support body disposed within the reset bore, the support body defining the check valve seat.

12. The lost motion exhaust rocker assembly as defined in claim 2, wherein the reset device further includes a support body disposed within the reset bore, and a separately formed check valve seat member disposed within the support body, the check-valve seat member defining the check valve seat.

13. The lost motion exhaust rocker assembly as defined in claim 2, wherein the at least one exhaust valve includes two exhaust valves, and wherein the stop member is an exhaust valve bridge of the internal combustion engine.

14. The lost motion exhaust rocker assembly as defined in claim 2, wherein the reset device further includes a reset cap closing an upper end of the reset bore, and a check valve spring disposed in the reset bore between the reset cap and the upper end of the valve closing member, wherein the upper end of the valve closing member further defines a pocket configured to receive the check valve spring, and wherein the check valve spring is configured to bias the sealing portion toward the check valve seat.

15. The lost motion exhaust rocker assembly as defined in claim 1, further comprising an accumulator device including an accumulator piston and an accumulator pressure control spring disposed in a cylindrical accumulator bore fluidly connected to a pressurized hydraulic fluid supply conduit via an accumulator conduit, wherein the accumulator bore is further fluidly connected to the reset conduit via the accumulator conduit such that the hydraulic fluid discharged from the actuation cavity is stored in the accumulator bore at a pressure sufficient to refill the actuation cavity during a subsequent engine cycle.

16. The lost motion exhaust rocker assembly as defined in claim 15, wherein the accumulator device is mounted to the exhaust rocker arm.

17. The lost motion exhaust rocker assembly as defined in claim 1, further comprising a supplemental check valve disposed in a supplemental valve cavity formed within the exhaust rocker arm, the supplemental valve cavity formed separately and spaced apart from the reset bore and the actuation bore.

18. The lost motion exhaust rocker assembly as defined in claim 1, wherein the actuation device further includes a supplemental check valve integrated into the actuation piston.

19. The lost motion exhaust rocker assembly as defined in claim 1, wherein the reset device further includes a threaded support body received in a threaded opening in the exhaust rocker arm, the threaded support body configured to adjustably engage the reset device so as to adjust normal valve lash.

20. A method of operating the lost motion exhaust rocker assembly as defined in claim 1, the method comprising:

mechanically and hydraulically biasing the reset check valve toward the closed position during a lost-motion rotation of the exhaust rocker arm;

executing a brake valve lift of the at least one exhaust valve; and switching the reset check valve to the open position and releasing the hydraulic fluid from the actuation cavity so as to reset and close the at least one exhaust valve.

* * * * *